US006040267A

United States Patent [19]

Mano et al.

[11] Patent Number: 6,040,267

[45] Date of Patent: Mar. 21, 2000

[54] IMAGE FORMING METHOD

[75] Inventors: Shigeru Mano; Hiroshi Watanabe; Kaori Fukumuro; Yorihiro Yamaya, all of Hino, Japan

[73] Assignee: Konica Corporation, Tokyo, Japan

[21] Appl. No.: 09/021,996

[22] Filed: Feb. 11, 1998

[30] Foreign Application Priority Data

Feb. 13, 1997 [JP] Japan ..... 9-028934
Jun. 17, 1997 [JP] Japan ..... 9-159869

[51] Int. Cl.[7] ..... B41M 5/035; B41M 5/28; B41M 5/38

[52] U.S. Cl. ..... 503/201; 503/202; 503/206; 503/227

[58] Field of Search ..... 8/471; 428/195, 428/913, 914; 503/227, 201, 202, 206

[56] References Cited

U.S. PATENT DOCUMENTS

| | | | |
|---|---|---|---|
| 4,987,049 | 1/1991 | Komamura et al. | 430/203 |
| 5,212,146 | 5/1993 | Komamura et al. | 503/227 |
| 5,432,144 | 7/1995 | Komamura et al. | 503/227 |
| 5,446,012 | 8/1995 | Ito et al. | 503/227 |
| 5,512,531 | 4/1996 | Miura et al. | 503/227 |
| 5,589,435 | 12/1996 | Ito et al. | 503/227 |
| 5,837,649 | 11/1998 | Nozaki | 503/227 |

FOREIGN PATENT DOCUMENTS

| | | | |
|---|---|---|---|
| 0 858 908 A1 | 1/1998 | European Pat. Off. | 503/202 |
| 4-89292 | 1/1992 | Japan | 503/202 |
| 5-42774 | 1/1993 | Japan | 503/202 |
| 5-42778 | 1/1993 | Japan | 503/227 |
| 7-108772 | 1/1995 | Japan | 503/204 |

*Primary Examiner*—Bruce H. Hess
*Attorney, Agent, or Firm*—Finnegan, Henderson, Farabow, Garrett & Dunner, L.L.P.

[57] ABSTRACT

In an image forming method in that an image-receiving layer of an image-receiving element is in contact with an ink sheet comprising a thermally transferable dye, and the dye is transferred to the image-receiving layer in accordance with imagewise-heating, the image-receiving layer comprises a metal ion-containing compound and the ink sheet has repeatedly a region comprising both the metal ion-containing compound and a chelatable dye and a region comprising the metal ion-containing compound and no thermally transferable dye and the dye-containing region of the ink sheet is subjected to imagewise-heating, and to the image part formed on the image-receiving layer, the metal ion-containing compound is transferred by heating the region comprising the compound containing the metal ion. (2) In the above-mentioned (1), the image-receiving layer comprises substantially no metal ion-containing compound.

11 Claims, 1 Drawing Sheet

IMAGE FORMING METHOD

FIELD OF THE INVENTION

The present invention relates to an image forming method in which an image is formed by transferring a thermally diffusible dye contained in an ink sheet to an image-receiving layer employing thermal transfer, and more specifically to a technology for the improvement in the keeping quality of a transferred image.

BACKGROUND OF THE INVENTION

As a multicolor or single-color image forming technology, this technology has been known in that an ink sheet containing a sublimable dye is in contact with an image-receiving layer of a image-receiving element and is heated by a thermal head, etc. so that the sublimable dye is transferred imagewise to the image-receiving layer.

In such the transferred image forming technology, the image preservation quality of a post chelate sublimable dye image in which a metal chelate is formed by allowing a metal ion-containing compound (metal source) to react with a post chelate type dye (post chelate dye) employed as the sublimable dye has been epochally improved as compared to the conventional sublimable dye image.

It has been known that the image preservation quality of the post chelate sublimable dye image is improved as a chelation ratio becomes higher which is obtained by allowing a post chelate dye supplied from the ink sheet to react with the metal source in the image-receiving layer.

As a method to increase the chelation ratio, a technology has been proposed in that an image formed by transfer is treated at high temperature employing a thermostat or another heating device (Japanese Patent Publication Open to Public Inspection No. 4-89292 and Japanese Patent Application No. 5-258397). However, in this method, another device is required in addition to a thermal transfer printer and thus, a problem is caused in that the apparatus becomes large.

As a technology to solve the above-mentioned problem, a method has been proposed in that a transparent transfer foil containing a metal source is transferred onto an image formed on thermally diffusible dye-receiving layer from an ink sheet containing a thermally diffusible dye which can form a chelate complex with a metal source (Japanese Patent Publication Open to Public Inspection No. 5-42774). However, this method exhibits disadvantages such that because the transparent foil is transferred onto an image, the surface texture is altered and the metal source in the transfer foil is not efficiently supplied to dyes not involved in reaction. When the amount of the metal source in the image-receiving layer is excessively increased to increase the chelation ratio, the hue of the metal source appears on the white background of the image-receiving sheet and the hue has to be adjusted by the addition of a dye, etc. This is not preferable for the white background in terms of cost and density.

SUMMARY OF THE INVENTION

An object of the present invention is to provide a technology to improve the preservation quality of a thermally transferred image formed on an image-receiving layer without the increase in size of an apparatus and the extreme extension of a processing time. Another object of the present invention is to provide technology to accomplish the above-mentioned object without the degradation of the hue of an image-receiving sheet.

The invention and its embodiment are described.

A dye-containing ink sheet used in the present invention comprises a dye-containing region which comprises a dye chelatable with the metal ion-containing compound and preferably, in addition thereto, a metal ion-containing compound- containing region which comprises a metal ion-containing compound and substantially no dye. An image-receiving element comprises an image-receiving layer on a support.

The image forming process comprises the following steps;

An image-receiving layer of an image-receiving element having the image-receiving layer and a dye-containing region of the ink sheet are brought into contact and are subjected to imagewise-heating by a heating device and the dye of the ink sheet is transferred to the image-receiving layer to form an image on the image-receiving layer, the image receiving element in which a transferred image was formed by transferring imagewise dye and the metal ion-containing compound-containing region of the ink sheet are brought into contact and are subjected heating by a heating device whereby the metal ion-containing compound which is contained in the metal ion-containing compound-containing region is transferred to the image receiving layer by the heating device.

In one of the embodiment the dye-containing region is composed of an yellow dye-containing region, a magenta dye-containing region and a cyan dye-containing region and the metal ion-containing region is formed next those dye-containing regions.

In one of the embodiment the above-mentioned dye-containing region is a black dye-containing region and the metal ion-containing compound-comprising region is formed next the dye-containing regions.

In one of the embodiment the above-mentioned dye-containing region is composed of an yellow dye-containing region, a magenta dye-containing region, a cyan dye-containing region and a black dye-containing region and a metal ion-containing compound-comprising region is formed next these dye forming regions.

The image-receiving layer may further comprise the metal ion-containing compound.

Preferably an image-receiving layer and/or an ink sheet comprises a release agent.

The heating device is preferably a thermal head and the transfer of a sublimable dye and a metal ion-containing compound to an image-receiving layer is carried out by the same thermal head.

EXPLANATION OF REFERENCE NUMERALS

Figure 1:
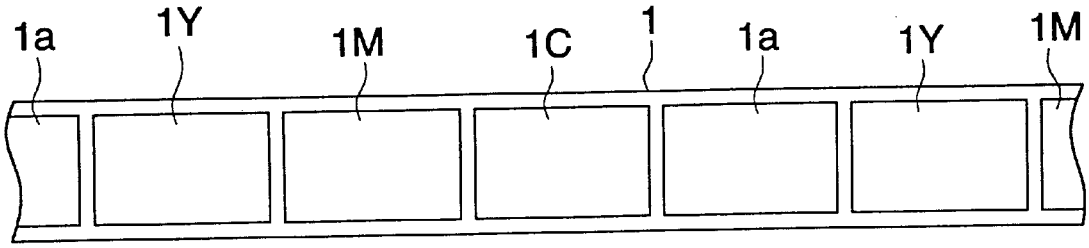
FIG. 1 is one example of the arrangement of the dye-containing regions and a metal source-containing region

1. Ink sheet
1Y. Yellow dye-containing region
1M. Magenta dye-containing region
1C. Cyan dye-containing region
1*a*. Metal source-containing region
11. Winding roll 12. Thermal head
13. Platen roller
14. Image-receiving element

DETAILED DESCRIPTION OF THE INVENTION

The present invention is explained in detail below.

The image-receiving element of the present invention is composed of at least a support and an image-receiving layer formed on the support.

The supports for the image-receiving element may include, for example, various kinds of paper such as paper, coat paper and synthetic paper (composite material in which paper is laminated on polyethylene, polypropylene, polystyrene, etc.); various kinds of plastic films or sheets such as vinyl chloride series plastic sheet, ABS resin sheet, polyethylene terephthalate base film, polyethylene naphthalate base film, etc.; film or sheet made of various kinds of metals; film or sheet made of various kind of ceramics, etc.

In case that the support is prepared by a material other than metals or ceramics especially by the above-mentioned synthetic paper, a white pigment (for example, titanium white, magnesium carbonate, zinc oxide, barium , silica, talc, clay, calcium carbonate, etc.) is preferably added to the support in order to improve the definition of an image formed in the later process. The thickness of the support is suitably from 20 to 1,000 $\mu$m and preferably from 20 to 800 $\mu$m.

The image-receiving layer accepts a dye which is diffused upon heating from the ink layer of the ink sheet. The image-receiving layer is basically composed of a binder which accepts and immobilize the diffused dye to form a dye image and additives if neccessary. As a method to form the image-receiving layer on the surface of the support, a coating method can be illustrated in that a coating liquid is prepared by dispersing or dissolving components forming the image-receiving layer and coat dried on the surface of the above-mentioned support, or a laminating method can be illustrated in that a mixture containing components forming the above-mentioned image-receiving layer is laminated on the surface of the support employing melt extrusion. The thickness of the image-receiving layer formed on the surface of the support is usually in the range of from 0.5 to 50 $\mu$m and preferably from 1 to 20 $\mu$m.

As the binder for an image-receiving layer, there can be employed binders such as vinyl chloride series resins, polyester series resins, polycarbonate series resins, acryl series resins, polyvinyl acetal series resin and various heat resisting resins. There is no restriction for the selection of the binder. In view of image preservation quality, etc., polyvinyl acetal resins or vinyl chloride series resin are preferred. As the above-mentioned polyvinyl acetal series resins, there can be illustrated polyvinyl acetal resins, polyvinyl acetoacetal resins, polyvinyl butyral resins, polyvinyl formal resins, etc. As the above-mentioned vinyl chloride series resins, copolymers of polyvinyl chloride resin and vinyl chloride can be included. As the vinyl chloride copolymers, there can be provided a copolymer of vinyl chloride containing vinyl chloride of 50 mole percent or more as a monomer unit with the other comonomer. In addition to the above-mentioned polyvinyl acetal series resins and vinyl chloride series resins, the polyester series resins can be suitably employed as the image-receiving layer for thermal transfer. The polyester series resins can include, for example, polyethylene terephthalate, polybutylene terephthalate and compounds described in Japanese Patent Application Open to Public Inspection Nos. 58-188659 and 62-244696. In addition, as the polycarbonate series resins, for example, various kinds of compounds described in Japanese Patent Publication Open to Public Inspection No. 62-169694 can be included. As the acryl series resins, for example, polyacryl ester can be included. As heat-resisting resins, various kinds of known heat-resisting resins can be employed, as far as they exhibit good heat resistance, no extremely low softening point or glass transition point (Tg), appropriate compatibility with the above mentioned vinyl chloride series resins and substantially colorlessness. "Heat resistance" mentioned herein means that during the storage at high temperatures, a resin itself causes no coloration such as yellow stain and no extreme degradation of the physical strength. The softening point of the above-mentioned heat resisting resin is preferably in the range of from 30 to 200° C. and specially, its Tg is preferably from 50 to 150° C. The softening point of less than 30° C. is not preferred because the ink sheet and the image-receiving layer may be fused each other during thermal dye transfer. The softening point of 200° C. or higher is not preferable because sensitivity of the image-receiving layer decreases. As heat resisting resins meeting the above-mentioned requirements, phenol resin, melamine resin, urea resin ketone resin, etc. are illustrated. However, of them, urea aldehyde resin and ketone resin are particularly preferred. The urea aldehyde resin is prepared by condensation between urea and aldehydes (mainly, formaldehyde) and the ketone resin is prepared employing the condensation reaction between ketone and formaldehyde.

As the binder of the image-receiving layer, resins mentioned below can be further employed.

Polyolefin series polymers such as polypropylene, vinyl halide resins except for the above mentioned (polyvinylidene chloride, etc.), vinyl polymers except for the above-mentioned (polyvinyl acetate , etc.), polystyrene series resins, polyamide series resins, copolymer series resin of olefin such as ethylene, propylene, etc. with the other vinyl monomer, ionomer, cellulose series resins such as cellulose diacetate, etc., polyurethane, polyimide resin, epoxy resin, etc.

Combination of a polycarbonate resin with an aromatic polyester resin described in Japanese Patent Publication Open to Public Inspection No. 5-246152; polyvinyl acetal series resins having a carboxyl group, the above-mentioned polyvinyl acetal series resins in which a component constructing the above-mentioned carboxyl group is an addition polymerizing monomer having a carboxyl group and resins in which the number of monomer units having the above-mentioned monomer is in the range of from 0.5 to 20 percent by weight disclosed in Japanese Patent Publication Open to Public Inspection No. 5-246151; vinyl chloride copolymer resins having an epoxy group described in Japanese Patent Publication Open to Public Inspection No. 5-246150; random-co-polycarbonate resins described in Japanese Patent Publication Open to Public Inspection No. 5-131758; polyester resins in which at least one of a diol component and an acid component contains an aliphatic cyclic compound and polyester resins in which the aforesaid aliphatic cyclic compound is tricyclodecane dimethanol, cyclohexanedicarboxylic acid, cyclohexane dimethanol or cyclohexanediol (employing the aforesaid resin, resistance such as light resistance, finger mark resistance, plasticity resistance of an image is improved.) described in Japanese Patent Publication Open to Public Inspection No. 5-64976; polyamide resins containing isophorodineamine as a component and resins having a molecular weight of the aforesaid resin in the range of from 5,000 to 20,000 and a softening point of from 50 to 170° C. described in Japanese Patent Publication Open to Public Inspection No. 4-299187; water resins composed of hydrophobic resin solution described in Japanese Patent Publication Open to Public Inspection No. 4-347690; polyamide resins having an amine value of 3 or less, the above-mentioned polyamide resins having a molecular weight in the range of 5,000 to 20,000 and a softening point of 50 to 170° C. and the above-mentioned polyamide resins having an acidic component selected from dimer acid, propionic acid, adipic acid or azelaic acid described in Japanese Patent Publication Open to Public Inspection No. 4-299188; polyurethane resins and polyester resins described in Japanese Patent Publication Open to Public Inspection No. 4-299184; high molecular substances having coating layer forming or film forming capability, the above-mentioned substances and hardened substances having compositions containing B1 and/or B2 component described in Japanese Patent Publication Open to Public Inspection No. 4-223194; synthetic resins described in Japanese Patent Publication Open to Public Inspection No. 4-131287; urethane-modified polyester resins described in Japanese Patent Publication Open to Public Inspection No. 4-43082; vinyl chloride/vinyl acetate copolymers having an average degree of polymerization of 400 or less described in Japanese Patent Publication Open to Public Inspection No. 4-135794; acid resins having an acid value of 2 or more such as, for example, those having an ester bond, for example, (a) polyester resins, polyacrylic resins, polycarbonate resins, polyvinyl acetate resins, styreneacrylic resins, vinyltoluene acrylic resins, (b) those having a urethane bond, for example, polyurethane resins, etc., (c) those having amide bond, for example, polyamide resins (nylon), (d) those having a urea bond, for example, urea resins, etc., (e) those having a high polar bond, for example, polycaprolactone resins, polystyrene resins, polyacrylonitrile resins, etc. (of these, polyester series resins are particularly preferred) described in Japanese Patent Publication Open to Public Inspection No. 2-107485; thermoplastic resins and reaction products of at least two or more of compounds (amino resins having a melamine skeleton, urea skeleton, benzoguanamine skeleton, or glycoluryl skeleton and isocyanates, etc.) having a reactive functional group (amino resins having a melamine skeleton, urea skeleton, benzoguanamine skeleton and isocyanates) described in Japanese Patent Publication Open to Public Inspection No. 2-107485; thermoplastic resins having a number average molecular weight of 15,000 or less (which are excellent in rapid drying during production, and peeling properties from a heat transfer sheet during image formation, chromogenic density and definition) and as the aforesaid thermoplastic resins, vinyl chloride acrylstyrene copolymers (vinyl chloride acrylstyrene copolymers, vinyl chloride vinyl acetate acrylstyrene coplymers, vinyl chloride vinyl acetate styrene copolymers, vinyl chloride butylacrylstyrene coplymers, vinyl chloride butylacryl copolymers, vinyl chloride methacrylstyrene copolymers, vinyl chloride vinyl acetate methacrylstyrene copolymers, vinyl chloride butylacrylmethacrylstyrene copolymers, vinyl chloride vinyl acetate butylacrylmethacryl styrene copolymers, etc.) described in Japanese Patent Publication Open to Public Inspection No. 7-40670; aldehyde-modified vinyl alcohol resins and polyester resins having a number average molecular weight of 10,000 or less (advantages: improvements in durability of image density, light resistance, finger print resistance, thermoplasticity, etc.), the above-mentioned polyester resins in which aldehyde modification ratio of the aldehyde-modified vinyl alcohol resin is between 30 and 50 percent, the above-mentioned polyester resins having the aldehyde-modified vinyl alcohol resin of an average degree of polymerization of 200 to 3,000, the above-mentioned polyester resins in which one part of polyol component and/or acid component is a aliphatic cyclic compound, the above-mentioned polyester resins in which the aldehyde modification is of formalin, acetoaldehyde, butyraldehyde (acetoaldehyde or butyl aldehyde is particularly preferred.) described in Japanese Patent Publication Open to Public Inspection No. 5-270151; resins having a tensile strength of 200 kg/cm$^2$ or more (advantages: prevention of crack formation of an image-receiving layer, for example, polyester series resins, polyurethane resins, butyral series resins, polyolefin series resins such as polypropylene, etc., polyvinyl chloride, vinyl chloride-vinyl acetate copolymer series resins, ionomer, cellulose series resins such as cellulose diacetate, etc. polycarbonates, etc. (those which are particularly preferred are the polyester series resins and vinyl chloride-vinyl acetate copolymer series resins) described in Japanese Patent Publication Open to Public Inspection No. 6-115272; mixtures of polyvinyl alcohol and synthetic resin emulsion having a glass transition temperature of −100 to 20° C. and a polar group described in Japanese Patent Publication Open to Public Inspection No. 6-79974; mixtures of an aqueous dispersion of polyester resin which is insoluble or hardly soluble to a solvent and an aqueous dispersion of a thermoplastic resin other than the above-mentioned polyester resin described in Japanese Patent Publication Open to Public Inspection No. 6-79974; reaction products of polyalkylene polyols with organic polyisocyanates described in Japanese Patent Publication Open to Public Inspection No. 6-15966; reaction products of polyester series resins with polyisocyanates described in Japanese Patent Publication Open to Public Inspection Nos. 58-215398, 61-199997, 2-178089 and 2-86494; reaction products of vinyl chloride-vinyl acetate copolymers having an active hydrogen with polyisocyanates described Japanese Patent Publication Open to Public Inspection in Nos. 1-160681, 1-123794 and 3-126587; thermoplastic resins having a hydroxide group, for example, polyvinyl acetal resins, the above-mentioned polyvinyl acetal resins in which the amount of polyvinyl alcohol unit is from 5 to 50 weight percent, vinyl chloride-vinyl acetate copolymers, the above-mentioned vinyl chloride-vinyl acetate copolymers in which the containing amount of polyvinyl alcohol unit is from 1 to 30 weight percent, polyesters, partially saponified polyvinyl acetate, partially or completely saponified compounds of vinyl chloride-vinyl acetate copolymers, acryl resins, polyurethane resins, etc., those which are particularly preferred are the polyvinyl acetal resins and vinyl chloride-vinyl acetate copolymers, preferred polyvinyl acetal resins are polyvinyl formal resins, polyvinyl acetoacetal resins and vinyl butyral resins (advantages: bridged products composed of the above-mentioned resin with a crosslinking agent are excellent in releasability and excellent in chromogenic density, definition, various durability and anti-embossing properties.) described in Japanese Patent Publication Open to Public Inspection No. 6-8646; polyvinyl acetal resins in which the containing amount of polyvinyl alcohol unit is 10 weight percent or more (or from 10 to 50 weight percent, the above-mentioned polyvinyl acetal resins having a degree of polymerization of 100 to 10,000, etc. described in Japanese Patent Publication Open to Public Inspection No. 5-294076.

Furthermore, in the case of the formation of the image-receiving layer, the above-mentioned resins may be crosslinked or hardened by radiation rays, heat, moisture, catalysts, etc. employing the reactive points (when there is no reactive point, it is rendered to the resin.) In the case, radiation ray active monomer such as epoxy or acryl and the crosslinking agent such as isocyanate may be utilized and those monomers and crosslinking agents may be added to the image-receiving layer as they are or may be enveloped in micro-capsules.

The image-receiving layer may comprise a metal ion-containing compound (hereinafter referred to as a "metal source") which is capable of forming a metal chelate with a dye in addition to a binder. When the metal source is incorporated in the image-receiving layer and a chelatable dye (hereinafter referred to as a "post chelate dye") with the metal source is employed as a dye incorporated in the dye-containing region of the ink sheet, the formed dye image may exhibit excellent advantages of high transferred density, high image preservation quality and especially, penetration resistance.

As the metal source, inorganic or organic salts of metal ions and metal complexes are illustrated and of those, organic acid salts or complexes are preferred. As the metal, single valent or polyvalent metals in the I to VIII Group in the Periodic Table are illustrated up and of these, Co, Cr, Cu, Fe, Mg, Mn, Mo, Ni, Sn, Ti and Zn are preferred and Ni, Cu, Cr, Co and Zn are particularly preferred. Specific examples of the metal source include $Ni^{2+}$, $Cu^{2+}$, $Cr^{2+}$, $Co^{2+}$, and $Zn^{2+}$, and salts of aliphatic group such as acetic acid, stearic acid, etc. or salts of aromatic carboxyl acids such as benzoic acid, salchilic acid, etc. Furthermore, complexes represented by the following general formula (1) are particularly preferred which can be consistently added to the image-receiving layer and are substantially colorless.

$$[M(Q1)_X(Q2)_Y(G3)_Z]^{P+}(L^-)^P \qquad \text{General formula (1)}$$

In the general formula (1), M represents a metal ion, and represents preferably $Ni^{2+}$, $Cu^{2+}$, $Cr^{2+}$, $Co^{2+}$ or $Zn^{2+}$. $Q_1$, $Q_2$ and $Q_3$ each independently represents a coordination compound which can coordinate with a metal ion and each of those may be the same or different. The coordinated compounds may be selected from those described in "Kireto Kagaku (Chelate Science) (5)" (Konando). $L^-$ represents an organic anion group which includes specifically tetraphenyl boron anion, aklylbenzene sulfonic acid anion, etc. X represents 1, 2 or 3; Y represents 1, 2 or 0 and Z represents 1 or 0. These are determined according to 4-ligand coordination or 6-ligand coordination in the complex represented by the general formula (1) or according to the number of ligands of Q1, Q2 and Q3. P represents 1 or 2. As an specific example of this kind of the metal source, there may be illustrated those described in U.S. Pat. No. 4,987,049 or compound Nos. 1 to 50 exemplified in Japanese Patent Application No. 5-1011008.

The added amount of the metal source is preferably in the range of from 5 to 80 weight percent of the binder of the image-receiving layer and more preferably in the range of from 10 to 70 weight percent of the binder of the image-receiving layer. The excessively added amount of the metal source in the image-receiving layer is not preferred because of the appearance of metal source color in the background of the image receiving element.

To the image-receiving layer may be added a releasing agent, antioxidant, UV absorber, light stabilizing agent, filler, pigment, etc. Furthermore, a plasticizer as a sensitizer, heat solvent, etc. may be added.

The releasing agent can improve peeling properties of the ink layer of the ink sheet and the image-receiving layer of the image-receiving element. As this kind of the releasing agent, there are illustrated silicone oil (including those termed silicone resins); solid wax such as polyethylene wax, polypropylene wax, amide wax, Teflon powder, etc.; silicate compounds or those composite compounds; fluorine series or phosphoric acid ester series surface active agents; coupling agents; long chain alkyl compounds; polyoxyalkyl polyols, etc., and of these, the silicone oil is preferred.

The silicone oil is classified into a simply added type (simple addition type) and a hardening or reacting type (hardening-reaction type). In the case of the simple addition type, a modified silicone oil is preferably employed, are illustrated polyester-modified silicone resins (or silicone-modified polyester resins), acryl-modified silicone resins (or silicone-modified acrylic resins), urethane-modified silicone resins (or silicone-modified urethane resins), cellulose-modified silicone resin (or silicone-modified cellulose resins), alkyd-modified silicone resins (or silicone-modified alkyd resins), epoxy-modified silicone resins (or silicone-modified epoxy resins), etc.

As the hardening-reaction type silicone oil, for example, are illustrated modified silicone oil having a reactive group mentioned below.

(a) amino-modified silicone having an amino group

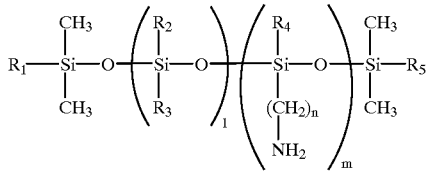

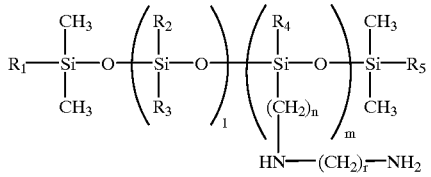

(b) epoxy-modified silicone having an epoxy group

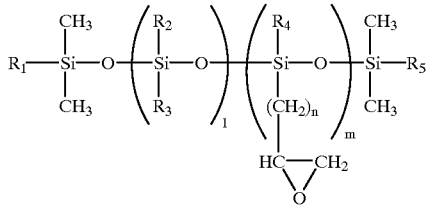

(c) modified silicone having another reactive group

Modified silicone represented by the following general formula and determined by a reaction group: $R_6$.

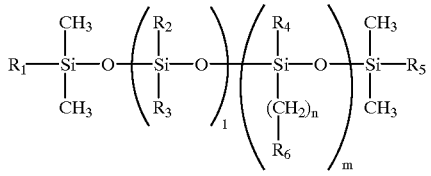

$R_6$: isocyano-modified silicone of —NCO $R_6$: alcohol-modified silicone of —OH $R_6$: carboxyl-modified silicone of —COOH Further, in the general formulas (structural formulas) of the above-mentioned (a) to (c), $R_1$ to $R_5$ each independently represents an organic group which is mainly a methyl group or an alkyl group other than the methyl group or a phenyl group and 1. m and n each independently represents an integer of 1 or more determined appropriately according to the molecular weight of a releasing resin. Further, the atom group of 1 and m parts is randomly copolymerized.

The silicone mentioned above is employed in suitable combination for carrying out the hardening reaction according to a reaction scheme. As the reaction scheme, the modified silicone having an amino group or a hydroxyl group reacts with each of the modified silicone having an epoxy group, an isocyano group or a carboxyl group.

As those of the catalyst hardening type, the following two types (d) and (e) of silicones are illustrated.

(d) those are alcohol-modified silicones which can undergo dehydration polymerization reaction between two silicones.

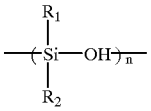

(catalysts: carboxylic acid salts, etc. of titanate, zinc, iron, etc.)

(e) those are composed of vinyl-modified silicone and vinyl-modified silicone in which a part of the organic group is —H.

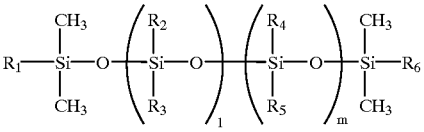

(catalysts: metal catalysts of platinum series, etc.)

Further, in the above-mentioned general formulas (structural formulas) (d) to (e), $R_1$ to $R_6$ each independently represents an organic group which is mainly a methyl group and may be an alkyl group or a phenyl group other than the methyl group. However, in (e), in the case of the vinyl-modified silicone, any of $R_1$ to $R_6$ is a vinyl group (—CH═$CH_2$), while in the case of silicone having —H in a part of the organic group or the vinyl-modified silicone, any of $R_1$ to $R_6$ is a vinyl group. Particularly, in the case of the vinyl-modified silicone, in addition to —H, at least one of $R_1$ to $R_6$ is a vinyl group. n, 1 and m each independently represents an integer of 1 or more decided appropriately according to the molecular weight of a releasing resin. Further, the atom groups of 1 and m parts are randomly polymerized.

As other specific examples of vinyl modified silicones, the following modified silicones are illustrated.

(1)

One side end type

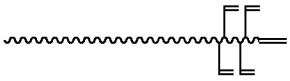

-continued (2)

Both side end type

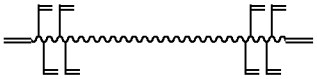

(3)

One side end + center type

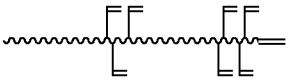

(4)

Both side end + center type

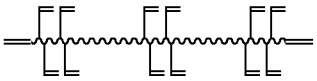

As a preferred example, when the silicone of the above-mentioned formula (1) and the silicone of the above-mentioned formula (4) are mixed and undergo catalytic hardening, the reaction is schematically shown as follows.

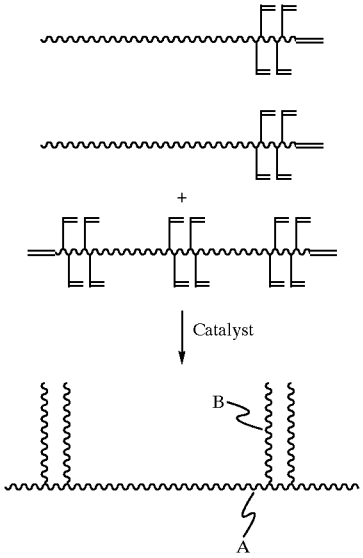

When the above-mentioned multifunctional silicone is employed together, the main chain A contributes to the increase in the strength of a coated layer and the pendant B contributes to the improvement in releasability and excellent coated layer properties and releasability are accomplished at the same time.

As specific examples of the above-mentioned vinyl-modified silicones of the hardening reaction type, compounds shown in the following Table 1 are illustrated.

TABLE 1

| No. | Molecular Weight | Reactive Group | Position of Reactive Group | Reactivity Basic Number | Silicone Skeleton |
|---|---|---|---|---|---|
| A | 3400 | Vinyl group | side end | 4/mole | vinyl siloxane |
| B | 3400 | Vinyl group | side end | 4/mole | vinyl |

TABLE 1-continued

| No. | Molecular Weight | Reactive Group | Position of Reactive Group | Reactivity Basic Number | Silicone Skeleton |
|---|---|---|---|---|---|
| | | | | | phenylsiloxane |
| C | 7000 | Vinyl group | side end | 4/mole | vinyl siloxane |
| D | 7000 | Vinyl group | side end | 13/mole | vinyl siloxane |
| E | 10000 | Vinyl group | side end | 13/mole | vinyl siloxane |
| F | 3500 | Vinyl group | both ends | 13/mole | vinyl phenylsiloxane |
| G | 3500 | Vinyl group | both ends | 32/mole | vinyl phenylsiloxane |
| H | 7000 | Vinyl group | both ends | 13/mole | vinyl phenylsiloxane |
| I | 17000 | Vinyl group | both ends | 13/mole | vinyl phenylsiloxane |
| J | 3500 | Vinyl group | side end + center | 4/mole | vinyl siloxane |
| K | 7000 | Vinyl group | side end + center | 4/mole | vinyl siloxane |
| L | 10000 | Vinyl group | side end + center | 4/mole | vinyl siloxane |
| M | 22000 | Vinyl group | side end + center | 4/mole | vinyl siloxane |
| N | 3500 | Vinyl group | both ends + center | 8/mole | vinyl phenylsiloxane |
| O | 7000 | Vinyl group | both ends + center | 8/mole | vinyl phenylsiloxane |
| P | 17000 | Vinyl group | both ends + center | 8/mole | vinyl siloxane |
| Q | 30000 | Vinyl group | both ends + center | 13/mole | vinyl siloxane |
| R | 3400 | Vinyl group | random | 13/mole | vinyl phenylsiloxane |
| S | 17000 | Vinyl group | random | 18/mole | vinyl phenylsiloxane |
| T | 36000 | Vinyl group | random | 25/mole | vinyl siloxane* |
| U | 42000 | Vinyl group | random | 34/mole | vinyl siloxane* |

*During the storage in a cool and dark place, the separation to many layers and the formation of precipitation are likely caused as the time goes by.

As the silicone oil having a long chain alkyl group (number of carbon atoms: n≧16) as a part of the side chain, the following chained polymers (f) to (I) are illustrated.

(f) releasing resins composed of polyolefin series chain polymers

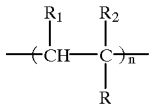

(g) releasing resins composed of polyester series chain polymers

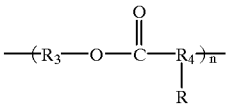

(h) releasing resins composed of polyurethane series chain polymers

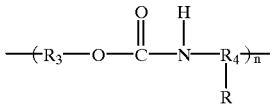

(i) releasing resins composed of polyamide series chain polymers

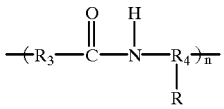

Further, in the above-mentioned general formulas (structural formulas) (f) to (i), R represents a long chain alkyl group of $—(CH_2)_n—CH_3$ (n≧16). At least one of $R_1$ and $R_2$ is a reactive group and $R_1$ or $R_2$ which is not the reactive group represents —H or an alkyl group, and $R_3$ and $R_4$ each represent a reactive group-containing chain of an aromatic or aliphatic group. n is an integer of 1 or more arranged adequately according to the molecular weight of the releasing resin.

The added amount of any of the above-mentioned releasing resins (a) to (i) is preferably in the range of from 0.2 to 20 weight percent of the resin for forming the image-receiving layer.

Further, in the present invention, the preparation of an excellent releasing layer along with efficient formation, can be readily accomplished by employing a releasing resin to which conditions described below are further applied as a prerequisite of the above-mentioned molecular weight.

(1) those in which a reactive group is localized are employed together.

Namely, a releasing resin in which reactive groups are positioned at one end, both ends or center of the main chain is employed together with a releasing resin in which reactive groups are randomly positioned at unspecified positions. According to the above, can be prepared the durable releasing layer which is excellent in releasing effect as compared with one which is prepared by the resin in that the reactive groups are randomly positioned. With reference to an embodiment in which reactive groups are localized, for example at one end or center, explanation is made below.

First, an embodiment in which reactive groups are localized in a releasing resin composed of the reaction hardening type or catalyst hardening type silicone

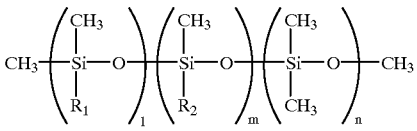

(a) Case of localization at one end
$R_1$ is a reactive group, 1≦1≦10,
m+n≧20, $R_2$ is a methyl group or an alkyl group or phenyl other than the methyl group.

(b) Case of localization at center
$R_2$ is a reactive group and 1≦m≦10,
1≧5, n≧5, 1+n≧20, $R_1$ is a methyl group or an alkyl group or phenyl group other than the methyl group.

Here, the reactive group is an amino group, an epoxy group, an isocyano group, a carboxyl group, a hydroxide group, a vinyl group, etc. However, when the reactive group is the vinyl group, it is employed together with the silicone having —H or a hydroxide group at the position of an organic group is employed.

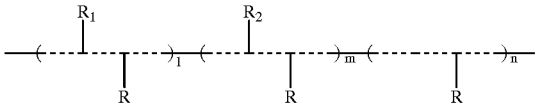

Further, the above-mentioned ( . . . . . ) is an abbreviated expression showing the main chain in chain polymers (f) to (i) and R represents $—(CH_2)_n—CH_3$ ($n \geqq 16$)

(a) Case of localization at one end $R_1$ is a reactive group, $1 \leqq 1 \leqq 10$, $m+n \geqq 20$, $R_2$ is H.

(b) Case of localization at center $R_2$ is a reactive group and $1 \leqq m \leqq 10$, $1 \geqq 5$, $n \geqq 5$, $1+n \geqq 20$, $R_1$ is H.

The reactive group herein is a reactive group bonded to the chain of an aliphatic or aromatic compound.

(2) Reaction hardening type or catalyst hardening type releasing resins should have a substituted group which is good in compatibility with a resin for forming an image-receiving layer.

Namely, the releasing resin having a substitute excellent in compatibility with a resin for forming the image-receiving layer is employed. Because the compatibility of the releasing resin depends especially on the type and amount of the organic group other than the reactive group, the organic group can be replaced with a substitute good in compatibility with a resin for forming the image-receiving layer. Accordingly, in accordance with the type of the resin for forming the image-receiving layer, a substitute group good in the compatibility with the above-mentioned resin is selected and a releasing resin of which organic group is replaced with the group in a predetermined ratio. Thus, at the preparation of an ink composition for forming the image-receiving layer, the good compatibility is secured between the releasing resin and the ink composition in the resin for forming the image-receiving layer and the releasing resin becomes preferably compatible with the resin for forming the image-receiving layer. As a result, the releasing layer prepared by employing the ink composition for forming the image-receiving layer with which the releasing resin is uniformly mix kneaded is also formed as a uniform layer and the releasing effect is exhibited uniformly over the whole layer without fluctuation.

As one example of the above-mentioned, the polyester resin is employed as the resin for forming the image-receiving layer and in contrast to this, is explained a case in which a silicone-based releasing resin is employed.

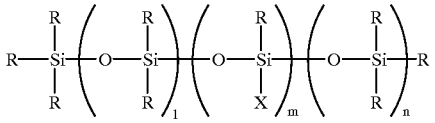

Further, in the above-mentioned formula, X represents a reactive group such as an amino group, an epoxy group, an isocyano group, a carboxyl group, a hydroxide group or a vinyl group. R represents a methyl group or an organic group having an alkyl group other than the methyl group. 1, m and n each independently represents an integer and groups of atoms in a part of 1, m and n are copolymerized randomly.

Because for the polyester resin herein, for example, a phenyl group is a highly compatible substituent, a part of R is replaced with the phenyl group. The replacement ratio to the phenyl group, when R is a methyl group, is methyl group/phenyl group=95 to 5/5 to 95 and preferably 70 to 20/30 to 80.

As mentioned above, by employing any one having a substituent excellent in compatibility with a resin for forming the image-receiving layer as the releasing resin, compatibility of the resin for forming the image-receiving layer with the releasing resin in the composition for forming the image-receiving layer is improved to increase the pot life of the above-mentioned composition and no separation is caused.

(3) in the case of the reaction hardening type releasing resin, any of those which decreases the equivalent of a reaction group or have the different equivalent is combined.

Namely, the releasing resin having the equivalent (=molecular weight/number of reaction groups per one molecule) of the reaction group of 300 or less, preferably in the range of 100 to 250 is employed. According to this, the number of reaction groups which the releasing resin has increases to improve the reactivity of the releasing resin at the formation of the releasing layer. As a result, the releasing layer is obtained which is hardened firmly in a short time.

In addition, among two types of reaction hardening type releasing resins, at least in one side, is employed a releasing resin composed of two or more of different equivalents of the reaction group. According to this, reactivity of the releasing resin is considerably improved at the formation of the releasing layer. As a result, the releasing layer which is firmly hardened in a short time is obtained. Here, as an embodiment of a combination of two types of releasing resins employed at the formation of the releasing layer, case in which two types A and B of reaction effective type are employed;

(i) as B, one type of the equivalent of a reaction group is employed and as B, those having different equivalent of the group of two or more are combined.

(ii) as B, one type of the equivalent of a reaction group is employed and as A, those having different equivalent of the group of two or more are combined.

(iii) as A and B, both of each having the different equivalent of the reaction group of two or more are combined.

Coupling agents include, for example, those having a long chain alkyl group which may be substituted with a fluorine atom. The long chain alkyl groups in the above mentioned coupling agent includes, for example, those such as hexyl, isohexyl, octyl, decyl, lauryl, tridecyl, tetradecyl, pentadecyl, heptadecyl, octadecyl, nonadecyl, eicosyl, docosyl, tricosyl, pentacosyl, hexacosyl group, etc. or its fluorine substituted group and of these, the alkyl group having carbon atoms of 15 or more is preferred.

Those which are preferred as the above-mentioned coupling agents include silane coupling agents and titanium coupling agents, and are preferably employed, for example, heptadecafluorodecyltrichlorosilane, heptadecafluorodecyltrimthoxysilane, heptadecafluorodecylmethyldichlorosilane, heptadecafluorodecylmethyldimothoxysilane, octadecyldimethylchlorosilane, octadecyltriethoxysilane, octadecyltromethoxysilane, octadecylmethyldichlorosilane, octadecylmethyldimethoxysilane, isopropyltriisoctanoyl titanate, isopropyl(dioctylpyrophosphate) titanate, isopropyltristearoyl titanate, isopropyltris(dioctylphosphate) titanate, isopropyldimethacrylisostraroyl titanate, etc.

Besides the incorporation the above-mentioned coupling agent into the image-receiving layer, it may be individually employed as an organic solution to form a releasing layer on the surface of the image-receiving layer. In this case, a small amount of a resin binder so as not to hinder the accomplishment of the object of the present invention may be combined in the above-mentioned solution. As such the resin binder, the thermoplastic resin for forming the image-receiving layer can be employed, as it is, and when the above-mentioned thermoplastic resin has an active hydrogen group such as a hydroxyl group, it can appropriately be crosslinked by the addition of polyisocyanate and close contact properties and layer strength of the formed releasing layer can be improved. As another preferred resin binder, the resin having a urethane bond and/or a urea bond is illustrated. The resin having the urethane bond and/or the urea bond is to be prepared by the reaction between a compound comprising a multifunctional active hydrogen and polyisocyanate.

As the compound comprising the active hydrogen, there are illustrated various kinds of polyols and polyamines having a low or high molecular weight. For example, there are illustrated ethylene glycol, diethylene glycol, triethylene glycol, polyethylene glycol, propylene glycol, dipropylene glycol, tripropylene glycol, polypropylene glycol, glycerin, pentaerythritol, bisphenol A, or ethylene oxide and/or propylene oxide addition compounds, for example, polymer or copolymer of a acryl monomer having a hydroxide group such as, for example, acrylpolyol, hydroxyethyl(meta) acrylate, a vinyl resin containing a vinyl alcohol unit such as a polymer or copolymer of vinyl acetate, a polyvinyl acetal resin, a cellulose resin, etc. However, the present invention is not limited to those polyols. Furthermore, polyamines include low molecular weight and high molecular weight polyamines such as ethylenediamine, propylenediamine, triethylenediamine, tripropylenediamine, polyethylene polyamine, polyethyleneimine, polyacrylamide, etc. However, the present invention is not limited to those polyamines.

In addition, as polyisocyanates employed if desired, there are illustrated various kinds of polyisocyanates employed widely in conventional polyurethane resins, polyurethane paints, polyurethane adhesives, etc., such as, for example, 2,4-tolylenediisocyanate (2,4-TDI), 2,5-tolylenediisocyante (2.5-TDI), 4,4'-diphenylmethanediisocyante (MDI), hexamethylenediisocyanate (HMDI), isophoronediisocyanate, triphenylmethanetriisocyanate, tris(isocyanatephenyl) thiphosphate, lysinestertriisocyanate, 1,8-diisocyante-4-isocyanatemethyloctane, 1,6,11-undecantriisocyanate, 1,3,6-hexamethylenetriisocyanate, bicycloheptanetriisocyanate, burete bonded HNDI, isocyanate bonded HMDI, trimethylolpropane-TDI 3 mole addition compound or mixtures of thereof. The reaction of the compound containing a multifunctional active hydrogen as mentioned above with polyisocyanate may be carried out prior to, during or after the formation of the releasing layer. In the case prior to the formation, the reaction is desirably carried out so that the resin formed is not gelled. When the resin binder as described above is employed, it is preferred to use those in the range of 10 to 1,000 parts by weight per one weight part of the above-mentioned coupling agent.

As long chain alkyl compounds, there are illustrated, for example, alcohols, amines, carboxylic acids, epoxy compounds, silane coupling agents, titanium coupling agents, aluminum series coupling agents, etc. having a long chain alkyl group, for example, a kexyl, isohexyl, heptyl, octyl, decyl, lauryl, tridecyl, tetradecyl, pentadecyl, heptadecyl, octadecyl, nonadecyl, eicosyl, docosyl, tricocsyl, pentacosyl, hexacosyl group, etc. Of these, the compounds having an alkyl group having carbon atoms of 15 or more are preferred.

Polyoxyalkylenepolyol is a general term for the following compositions (1), (2) and (3) and/or those reaction products.

(1) active hydrogen compound, polyisocyanat and alkylene oxide (2) active hydrogen compound, polyisocyanate and long chain alkylisocyanate (3) active hydrogen compound, polyisocyante and polymerizable monomer having a long chain alkyl group As the above-mentioned active hydrogen containing compounds, those as described below are employed. Furthermore, oligomers terminated with polyisocyante may be employed which have been previously prepared by reacting these active hydrogen compounds with polyisocyanate. As active hydrogen containing compounds, there are illustrated various kinds of polyols and polyamines having a low or high molecular weight. For example, there are illustrated ethylene glycol, diethylene glycol, triethylene glycol, polyethylene glycol, propylene glycol, dipropylene glycol, tripropylene glycol, polypropylene glycol, glycerin, pentaerythritol, bisphenol A, or ethylene oxide and/or propylene oxide addition compounds, for example, polymer or copolymer of a acryl monomer having a hydroxide group such as, for example, acrylpolyol, hydroxyethyl(meta) acrylate, a vinyl resin containing a vinyl alcohol unit such as a polymer or copolymer of vinyl acetate, a polyvinyl acetal resin, a cellulose resin, etc. However, the present invention is not limited to those polyols. Furthermore, as polyamines, there are illustrated low molecular weight and high molecular weight polyamines such as ethylene diamine, propylene diamine, triethylene diamine, tripropylenediamine, polyethylene polyamine, polyethylene imine, polyacrylamide, etc. However, the present invention is not limited to those polyamines.

In addition, as polyisocyanates employed if desired, there are illustrated various kinds of polyisocyanates employed widely in conventional polyurethane resins, polyurethane paints, polyurethane adhesives, etc., such as, for example, 2,4-tolylediisocyanate(2,4-TDI), 2,5-tolylenediisocyante (2.5-TDI), 4,4'-diphenylmethanediisocyante(MDI), hexamethylenediisocyanate(HMDI), isophoronediisocyanate, triphenylmethanetriisocyanate, tris (isocyanatephenyl)thiphosphate, lysinestertriisocyanate, 1,8-diisocyante-4-isocyanatemethyloctane, 1,6,11-undecantriisocyanate, 1,2,6-hexamethylenetriisocyanate, bicycloheptanetriisocyanate, burete bonded HNDI, isocyanate bonded HMDI, trimethylolpropane-TDI 3 mole-addition compound or mixtures of thereof. The added amount of those polyisocyanates vary according to the active hydrogen containing amount of the above-mentioned releasing polymer, amount of added active hydrogen containing compound, forming conditions of a releasing layer or releasing agent. In practice, the amount of 1.5 equivalent or less per one equivalent of the above-mentioned releasing polymer or active hydrogen of the active hydrogen-containing compound is generally employed.

The above-mentioned long chain alkyl isocyanates can be prepared by isocyanizing a long chain aliphatic amine. As examples of the long chain aliphatic amines, there are illustrated hexylamine, isohexylamine, heptylamine, octylamine, decylamine, raurylamine, tridecylamine, tetradecylamine, pentadecylamine, heptadecylamine, octadecylamine, nonadecylamine, eicosylamine, docosylamine, tricosylamine, pentacosylamine, hexacosylamine, etc. The long chain alkylisocyanates employed in the present invention are prepared by converting the amino group of those long chain alkyl amines to an isocyanate group. Of those long chain alkylisocyanates, those having 15 or more of carbon atoms, for example, octadecylisocyanate, etc. readily commercially available are particularly preferred.

The above-mentioned alkyl group containing addition polymerizable monomers include reaction products of addition-polymerizable unsaturated carboxylic acid such as acrylic acid, methacrylic acid, itaconic acid, maleic acid, etc. with long aliphatic alcohols or long chain aliphatic amine, esters of vinyl alcohols with long chain aliphatic acids. As carbon chains of the above-mentioned long chain alcohol, amine, carboxylic acid, etc. there are illustrated, for example, a hexyl, isohexyl, heptyl, octyl, decyl, lauryl, tridecyl, tetradecyl, pentadecyl, octadecyl, nonadecyl, eicosyl, docosyl, trocosyl, pentacosyl, hexacosyl group, etc. Of those long chain alkyl groups, those having 15 or more of carbon atoms, for example, alcohol, amine or carboxylic acid having a stearyl group, readily commercially available are particularly preferred.

Furthermore, the above-mentioned long chain alkyl group containing addition-polymerizable monomer may be individually polymerized or may be copolymerized together with other addition-polymerizable monomers. Particularly, when a polymer is allowed to react with polyisocyanate, preferably are copolymerized monomers having a group such as a hydroxyl group which reacts with an isocyanate group, for example, monomers subjected to ring-opening addition of moles (1 to 10 moles) of ethylene oxide, propylene oxide or caprolactone to a terminal hydroxyl group of 2-hydroxyethyl(meta)acrylate, 2-hydroxypropyl(meta) acrylate, 2-hydroxyethyl(meta)acrylate. As the other copolymerizable monomers, for example, various kinds of general monomers such as other (meta)acrylic acid esters, various carboxylic esters, styrene, vinyl chloride, vinyl pyrimidine, etc. In the case of copolymerization with those other addition-polymerizable monomers, a ratio of the long chain alkyl group containing addition polymerizable monomer is preferably in the range of from 30 to 95 mole percent of the total copolymer and when employing the active hydrogen-containing monomer, the ratio is preferably in the range of 5 to 70 mole percent. When the ratio of the long chain alkyl group-containing addition-polymerizable monomer is less than the above range, the polymer obtained exhibit insufficient releasing properties.

As the above-mentioned alkylene oxides, there are illustrated, for example, ethylene oxide, propylene oxide, butylene oxide, etc. When these alkylene oxides undergo addition polymerization to the above-mentioned active hydrogen compounds, either individual polymerization or copolymerization may be carried out and any order of the addition may be employed. Furthermore, as catalysts employed during the addition polymerization, there are illustrated generally basic catalysts such as sodium methylate, sodium hydroxide, potassium hydroxide, lithium carbonate, etc. However, Lewis acid catalysts such as boron trifluoride and amine series catalysts such as trimethylamine or triethylamine are also useful and the addition amount may be the same as commonly used. As particularly preferred polyoxyalkylenepolyols, the following general formulas (A) to (E) are particularly illustrated.

(A)

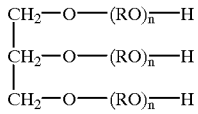

(B)

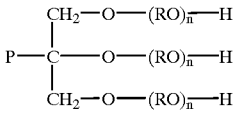

(C)

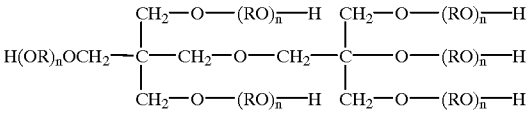

(D)

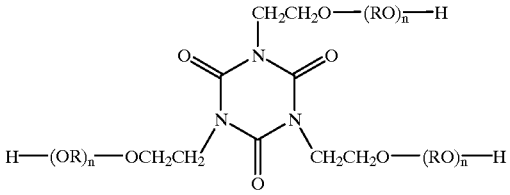

(E)

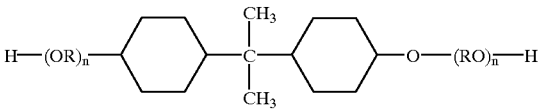

(wherein R represents

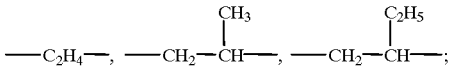

p represents

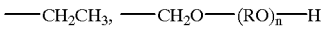

and n is a numerical figure wherein number average molecular weight is in the range of 200 to 5,000)

Organic polyisocyanates to enable the above-mentioned polyols to crosslink, include, for example, 2,4-tolylenediisocyanate (2,4-TDI), 2,6-tolylenediisocyante (2.6-TDI), 4,4'-diphenylmethanediisocyante (MDI), hexamethylenediisocyanate (HMDI), isophoronediisocyanate (IPDI), triphenylmethanetridiisocyanate, tris (isocyanatephenyl)thiphosphate, lysinestertriisocyanate, 1,8-diisocyante-4-isocyanatemethyloctane, 1,6,11-undecantriisocyanate, 1,3,6-hexamethylenetriisocyanate, bicycloheptanetriisocyanate, further, those termed isocyanate adduct compounds such as burete bonded HMDI, isocyanate bonded HMDI, trimethylolpropane-TDI 3 mole addition compound or mixtures of thereof.

When the above-mentioned polyoxyalkylenepolyols are allowed to react with the above-mentioned polyisocyanates, both are preferably mixed for the reaction so that the base number of the organic polycyanate is in the region of 0.8 to 2.5 times to the terminal hydroxide group of polyoxyalkylenepolyol. Furthermore, when the reaction is accomplished in a short time, it is useful to employ a catalyst. The catalysts include, for example, organic metal catalysts such as dibutyl tin dilaurate (DBTDL), dibutyl tin diacetate (DBTA), phenyl mercury propionic acid salt, octanic acid lead, etc. or amine-based catalysts such as triethylenediamine, N,N'-dimetylpiperazine, N-methylmotpholine, tetramethylguanidine, triethylamine, etc. The above-mentioned polyurethane resin can be employed individually or as a mixture and further, it can be employed together with the other thermoplastic resins, for example, polyolefin series resins such as polypropylene, etc., halogenated polymers such as polyvinyl chloride, polyvinyl vinylidene, etc., vinyl polymers such as polyvinyl acetate, polyacryl ester, polyvinyl acetal, etc. polyester series resins such as polyethylene terephthalate, polybutylene terephthalate, etc., polystyrene series resins, polyamide series resins, copolymers of olefin such as ethylene or propylene, etc. with other vinyl monomer, ionomer, cellulose series resins such as cellulose diacetate, etc., polycarbonates, etc.

Particularly, in the present invention, under the consideration of the transferability of thermally diffusible dye, it is preferred to add a releasing agent excellent in compatibility with a binder for the image-receiving layer. For example, when the vinyl chloride series resin is employed as a binder, it is preferred to employ a polyester-modified silicone resin together with it. As representative polyester-modified silicone resins, can be enumerated, for example, a copolymer of diol with dibasic acid or a block copolymer, that is, ring-opening polymer of polyester with dimethylpolysiloxane (including copolymers in which both ends or one side end of dimethylpolysiloxane is blocked by the above-mentioned polyester part, or inversely, the above-mentioned polyester is blocked by dimethylpolysiloxane). Or a copolymer can be illustrated which is prepared by bonding polysiloxane to the side chain (dimethyl) while making the above-mentioned polyester a main chain. The added amount of those simply addition type silicone oils cannot be uniformly determined because it varies variously according to its kind. However, generally speaking, the amount is usually in the range of from 0.5 to 50 weight percent and preferably 1 to 20 weight percent of the binder of the image-receiving layer.

Further, a releasing agent is dissolved or dispersed in an adequate solvent and coated on one part of the surface of the image-receiving layer and then dried. Thus, the releasing layer can be provided. In this case, solid wax such as polyethylene wax or polypropylene wax, etc. is preferably employed and acryl ester series, ethyleneacrylic acid series, or vinyl chloride series resins, etc. can be employed.

As the UV absorbers, those which function to absorb ultraviolet rays incident to dye images and are capable in thermal transfer are practiced. For example, there can be employed compounds described in Japanese Patent Publication Open to Public Inspection Nos. 59-158287, 63-74686, 63-145089, 59-196292, 62-229594, 63-122596, 61-283595, 1-204788, etc. and compounds known in the art as those which improve the durability of images in photography and the other image recording materials. The mixing ratio by weight of a binder to a UV absorber is preferably in the range of 1:10 to 10:1 and more preferably in the range of 2:8 to 7:3.

The antioxidants can include those described in Japanese Patent Publication Open to Public Inspection Nos. 59-182785, 60-130735, 1-127387 and compounds known in the art which improve the durability of images in photography and the other image recording materials. UV absorbers and light stabilizers, can include compounds described in Japanese Patent Publication Open to Public Inspection Nos. 59-158287, 63-74686, 63-145089, 59-196292, 62-229594, 63-122596, 61-283595, 1-204788, etc. and compounds known in the art which improve image durability in photography and the other image recording materials.

As fillers, inorganic fine particles or organic resin particles can be illustrated. The inorganic fine particles can include silica gel, calcium carbonate, titanium oxide, acid clay, activated clay, alumina, etc. The organic fine particles can include fluororesin particles, guanamine resin particles, acrylic resin particles, silicone resin particles, etc. The added amount of those inorganic or organic resin particles, though it varies according to specific gravity, is preferably in the range of from 0.1 to 70 weight percent. As pigments, representative examples can include titanium white, calcium carbonate, zinc oxide, barium sulfate, silica talc, clay, kaolin, activated clay, acid clay, etc.

As plasticizers, there can be illustrated phthalic acid esters (for example, dimethyl phthalatedibutyl phthalate, dioctyl phthalate, didecyl phthalate, etc.), trimellitic acid esters (for example, octyl trimellitate, isononyl trimellitate, isodecyl trimellitate, etc.), pyromellitic acid esters such as octyl pyromellitate, adipic acid esters, etc. Further, because the excessive addition of the plasticizer degrades the image preservation quality, the added amount of the plasticizer is generally in the range of 0.1 to 30 percent by weight of the binder of the image-receiving layer.

On the back side of the image receiving element, a slipping back layer may be provided.

When the slipping back layer is provided on the back side of the image-receiving element, an employed resin carries preferably low dyeability. Resins such as those, in practice, can include acrylate series resins, polystyrene series resins, polyolefin series resins, polyamide series resins, polyvinyl butyral, polyvinyl alcohol, cellulose acetate resins , etc. Furthermore, amorphous polyolefin resins can be employed which are described in Japanese Patent Publication Open to Public Inspection No. 7-186557. In addition to those, hardened resins which are prepared by hardening polyvinyl butyral, melamine, cellulose, acrylic series resin, etc. by means of chelate, isocyanate, radioactive ray radiation and the like are preferred. Those commercially available include, for example, BR85, BR80, BR113 (manufactured by Mitsubishi Rayon Co., Ltd.) as acrylic resins; APL6509, 130A, 291S, 150R (all manufactured by Mitsui Petrochemical Industries, Ltd.), Zeonex 480, 250, 480S (all manufactured by Nippon Zeon Co., Ltd.) as amorphous polyolefin resins; 3000-1 (manufactured by Denki Kagaku Kogyo K. K.) as polyvinyl butyral resins: SMR-20H, SMR-20HH, C-20, C-10, MA-23, PA-20, PA-15 (all manufactured by Shin-Etsu Chemical Co., Ltd.) as polyvinyl alcohol resins; L-30, Lt-35 (Mitsui Saiado Co.) as melamine resins. However, the present invention is not limited to resins mentioned above.

In order to improve automatic paper feeding adaptability, at least one of layers constructing the back side of the image-receiving element may comprise an organic and/or inorganic filler. In practice, there are illustrated polyethylene wax, bisamide, nylon, acrylic resin, crosslinked polystyrene, silicone resin, silicone rubber, talc, calcium carbonate, titanium oxide, etc. However, there is no particular limitation and any one can be employed.

Of the above-mentioned, in terms of wear of the paper feeding rubber roller in a printer and decrease in fluctuation of friction characteristics of a roller caused by transport, the nylon filler is particularly preferred, The nylon filler having a molecular weight of 100,000 to 900,000, shape in sphere and average particle diameter of 0.01 to 30 $\mu$m is preferred and particularly, one having a molecular weight of 100,000 to 500,000 and a average particle diameter of 0.01 to 10 μm is more preferred. Further, as the kind of the nylon filler, nylon 12 filler is more preferred than nylon 6 or nylon 66, because the nylon 12 filler is good in water proof and exhibits no change in characteristics by water adsorption.

The nylon filler has a high melting point and is thermally stable, bears good oil and chemical resistance and is hardly dyed with dyes. Furthermore, it carries self-lubricating properties and low friction coefficient. When having a molecular weight of 100,000 to 900,000, it is hardly worn and does not damage associate materials. Further, preferred average particle diameter is in the range of from 0.1 to 30 μm in the case of a thermal transfer image receiving element for reflection image and from 0.01 to 1 μm in the case of a thermal transfer image receiving element for transparent image. When the particle diameter is too small, the filler is hidden in the composition layer on the back side and does not achieve fully the slipping function. On the other hand, when the particle diameter is too large, projection from the back side composition layer becomes large to increase the friction coefficient or cause loss of the filler.

Further, any of the above-mentioned fillers are readily available on the market. For example, the polyethylene wax is available as SPRAY30 (manufactured by Sazol Co.) and W950 (Mitsui Petrochemical Industries Ltd.) and as the nylon fillers, for example, MW330 (manufactured by Jinto Toryo Co.) can be illustrated. The added amount of the filler is preferably in the region of from 0.012 to 20 weight parts per 100 weight parts of a binder of the added layer.

The center line average surface roughness Ra on the surface of the back side layer is preferably in the range of from 0.5 to 2.5 μm. In addition, the average number of projections per unit area is preferably from 2,000 to 4,500/$mm^2$. As a method to enable such properties, besides the preparation employing the filler as mentioned above, at the resin extrusion coating, the shape of the surface of the cooling roll is changed to the quality as mentioned above and the formation is performed by transferring the shape when cooling the extruded resin.

In order to increase adhesive force between the back side slipping layer and a base material sheet, an interlayer may be provided between them. As the embodiment of the preferred interlayer, the interlayer having a reaction hardening type resin is provided.

As the reaction hardening type resins, thermosetting resins/ionizing radiation setting resins as described in Japanese Patent Publication Open to Public Inspection No. 6-255276 are preferably employed.

The interlayer having the similar composition may be provided between the basic material sheet and the image-receiving layer.

The image-receiving layer of the present invention may be subjected to treatment to make matte surface and/or to adjust the degree of surface gloss according to the method described in Japanese Patent Publication No. 4-241993.

In the image-receiving element of the present invention, a transparent heat-absorbing substance may be incorporated in the image-receiving layer and/or a layer adjacent to the layer. With the accumulation of heat near the heat absorbing substance, a colorant can be efficiently transferred into the image-receiving layer by expanding it.

As the heat absorbing materials, various kinds of near infrared absorbing dyes are employed. For example, there can be employed nitroso compounds and the metal complexes, polymethine series dyes, squalirium series dyes, thiol nickel salts, phtharocyanine series dyes, triallylmethane series dyes, immonium series dyes, diimmonium series dyes, naphthoquinone series dyes, anthraquinone series dyes, etc. In addition, many transparent latent heat heat-accumulating materials are employed which are those such as, for example, chain hydrocarbons such as paraffin wax, etc., aromatic hydrocarbons such as paraxylene, etc. phenols, carboxylic acids such as stearic acid, clathrate hydrates such as $C_4H_8O.117H_2O$, etc., various alcohols, polymeric substances having a low glass transition point such as polyethylene, etc. Furthermore, photochemical reaction utilizing heat accumulating materials utilizing reaction heat generated by light isomerization are employed.

In the image-receiving element of the present invention, a layer containing air bubbles may be provided to increase cushion property.

As a means of the incorporation of air bubbles, heat expanding hollow particles or capsule-shaped hollow polymers can be utilized. Furthermore, decomposable blowing agents such as dinitropentamethylenetetramine, diaminobenzene, azobisisobutylnitrile, azodicarboamide, etc. may be utilized which are decomposed with heat to generate gases such as oxygen, carbon dioxide, nitrogen, etc.

The kind of the air bubble incorporated in the bubble-containing layer is preferably of dependent air bubbles in terms of the cushion property and heat insulation. For example, those are included which are described in Japanese Patent Publication Open to Public Inspection No. 6-270559.

Furthermore, the air bubble-containing layer itself may incorporate adhesives known in the art. However, in order to increase the adhesion with a base material sheet, a primer layer may be provided between the base material sheet and the air bubble-containing layer. As such the primer layer, for example, those which are described in Japanese Patent Publication Open to Public Inspection No. 5-270152, etc. can be employed.

In the present invention, the ink sheet is composed of at least a support and an ink sheet provided thereon and the above-mentioned ink layer comprises a dye-containing region composed of the ink layer having a thermally transferable post chelate dye and a UV absorber-containing region composed of an ink layer having substantially no thermally transferable dye and a thermally transferable UV absorber. Here, "having substantially no thermally transferable dye" means that the amount and/or quality of the thermally transferable dye is not incorporated which degrades the quality of the dye image formed on the image-receiving element by thermal transfer.

As the support for the ink sheet, there is no particular limitation as far as it exhibits good dimensional stability and withstands heat at recording with a heat-sensitive head and those known in the art can be employed.

In the present invention, the ink layer in the dye-containing region is fundamentally composed of at least a thermally transferable post chelate dye and a binder, and the ink layer in the metal source-containing region is fundamentally composed of at least a metal source and a binder.

As the binder of the ink layer, there can be illustrated, for example, cellulose series resins such as a cellulose addition compound, cellulose ester, cellulose ether, etc., polyvinyl acetal resins such as polyvinyl alcohol, polyvinyl formal, polyvinyl acetoacetal, polyvinyl butyral, etc., vinyl series resins such as polyvinylpyrrolidone, polyvinyl acetate, polyacrylamide, styrene series resins, poly(meta)acrylic acid series esters, poly(meta)acrylic acid, (meta)acrylic acid copolymer, rubber series resins, ionomer resins, olefin series resins, polyester resins, etc. Of these resins, the polyvinyl butyral, polyvinyl acetoacetal or cellulose series resins having excellent preservation quality are preferred.

As the binder of the ink layer, resins mentioned below can be employed.

In Japanese Patent Publication Open to Public Inspection No. 5-78437 there are illustrated reaction products of isocyanates with compounds having an active hydrogen selected from polyvinyl butyral, polyvinyl formal, polyesterpolyol and acrylpolyol, the above-mentioned reaction products in which isocyanates are diisocyanates or triisocyanates and the above-mentioned reaction products of 10 to 200 weight parts for 100 weight parts of the active hydrogen-containing compound; organic solvent-soluble high polymer in which intramolecular hydroxide groups in a natural and/or semi-synthesized water-soluble high polymer are esterified and/or urethanized, as the natural and/or semi-synthesized water-soluble high polymers, starch which is a polymer having an α-1,4-glucosido bond of α-glucose, water-soluble derivative of cellulose which is a polymer having a β-1,4-glucosido bond of β-glucose, alginic acid which is a polymer having a β-1,4-glucosido bond of a pyranose ring, malttriose which is a trimer of glucose, purpran which is a water-soluble polysaccharide bonded repeatedly with a 1,6 bond of a α-D-1,6-glucose, dextran which is a polymer composed of D-glucopyranose as a unit prepared from sugar, curdran which is a straight chain β-1,3-glucan having a β-glucosido bond at 1,3 bond of D-glucose; cellulose acetates having a degree of acetylation of 2.4 or more and degree of total replacement of 2.7 or more which are described in Japanese Patent Publication 3-264393; vinyl resins such as polyvinyl alcohol (Tg=85° C.), polyvinyl acetate (tg=32° C.), vinyl chloride/vinyl acetate copolymer (Tg=77° C.), etc. polyvinyl acetal series resins such as polyvinyl butyral (Tg=84° C.), polyvinyl acetoacetal (Tg=110° C.), etc., vinyl series resins such as polyacrylamide (Tg=165° C.), polyester resins such as aliphatic polyester (Tg=130° C.), etc. and the like; reaction products of isocyanates with polyvinyl butyral in which the weight of contained part of the vinyl alcohol is from 15 to 40 percent, described in Japanese Patent Publication Open to Public Inspection No. 7-52564, the above-mentioned reaction products in which the above-mentioned isocyanates are diisocyanates or triisocyanates, specifically, paraphenylenediisocyanate, 1-chloro-2,4-phenylenediisocyanate, 2-chloro-1,4-phenylenediisocyanate, 2,4-toluenediisocyanate, 2,6-toluenediisocyanate, hexamethylenediisocyanate, 4,4'-biphenylenediisocyanate, 4,4',4"-trimethyl-3,3',2-triisocyanate-2,4,6-triphenlcyanate, etc.; phenylisocyanate-modified polyvinyl acetal resins of the formula I described in Japanese Patent Publication Open to Public Inspection No. 7-32742; compounds obtained by hardening compositions consisting of one of isocyanate reactive cellulose or isocyanate reactive acetal resin, and one resin selected from isocyanate reactive acetal resin, isocyanate reactive vinyl resin, isocyanate reactive acrylic resin, isocyanate reactive phenoxy resin and isocyanate reactive styrol resin, and a polyisocyanate compound, described in Japanese Patent Publication Open to Public Inspection No. 6-155935; polyvinyl butyral resins (having preferably molecular weight of 60,000 or more, glass transition temperature of 60° C. or higher, more preferably 70° C. or higher and 110° C. or lower, weight percent of vinyl alcohol part of 10 to 40 percent of polyvinyl butyral resin, preferably from 15 to 30 percent); acryl-modified cellulose series resins, as the cellulose series resins, cellulose series resins (preferably ethylcellulose) such as ethylcellulose, hydroxyethylcellulose, ethylhydroxycellulose, hydroxypropylcellulose, methylcellulose, cellulose acetate, cellulose butyrate, etc. As organic solvents employed in the modification of the above-mentioned cellulose series resins with acrylic resins, there are provided, for example, ester series solvents such as methyl formate, ethyl formate, ethyl acetate, butyl acetate, etc., ketone series solvents such as acetone, methyl ethyl ketone, methyl isobutyl ketone, cyclohexanone, isophoron, etc., hydrocarbon series solvents such as toluene, benzene, xylene, etc., ether series solvents such as n-butyl ether, etc., and the cellulose series resins are preferably employed at a concentration of about 5 to about 50 weight percent.

The above-mentioned various binders are employed individually or in combination of two or more thereof.

The ink sheet comprises an ink layer composition having repeatedly a combination in which a metal source-containing region is provided next a dye-containing region. The dye-containing region can be one which contains two or more of dyes different in hue. For example, embodiments are enumerated in that the dye-containing region is composed of an yellow dye-containing region, a magenta dye-containing region and a cyan dye-containing region, and a metal source-containing region is arranged next these dye-containing regions; the dye-containing region is composed of a black dye-containing layer and the metal source-containing region is formed next the above-mentioned region and the dye-containing region is composed of the yellow dye-containing region, a magenta dye-containing region, a cyan dye-containing region and a black dye-containing region and a metal source-containing source is formed next these dye-containing regions.

"Black dye" described herein includes an embodiment in which in addition to black dyes, black hue is prepared by combination of two or more of dyes other than the black dye, for example, an yellow dye, a magenta dye and a cyan dye are mixed to form black hue.

The hue of a dye prior to the chelation and after the chelation may be the same or very different. Yellow of a yellow dye, magenta of a magenta dye, cyan of a cyan dye and black of a black dye described herein mean the hue of the dye after the chelation.

An example of the arrangement of the ink layer on the ink sheet is explained below with reference to the drawing., FIG. 1 shows one example of an embodiment in which a dye-containing region is composed of a yellow dye-containing region, a magenta dye-containing region and a cyan dye-containing region and a metal source-containing source is formed next those dye-containing regions. In FIG. 1, an ink sheet 1 is provided with each of ink layers in order of an yellow dye-containing region 1Y, a magenta dye-containing region 1M and a cyan dye-containing region 1C and next those dye-containing regions, is provided a metal source-containing source 1*a* which contains no thermally transferable dye and contains a metal source and a combination of those arrangements is repeated.

As the post chelate dyes incorporated in the ink layer in the dye-containing region, a dye of which the thermal transfer is possible and various compounds known in the art can be selected and employed. Preferably the dye is sublimable. Specifically, cyan dyes, magenta dyes, yellow dyes, etc. described in, for example, Japanese Patent Publication Open to Public Inspection Nos. 59-78893, 59-109349, 2-2133032-214719 and 2-203742 can be employed. Of the above-mentioned dyes, dyes which can form two-ligand chelate with the metal source are preferably employed. As such dyes, for example, those represented by the general formula (2) described below can be illustrated.

$$X_1—N=N—X_2—G \qquad \text{General formula (2)}$$

In the above-mentioned general formula (2), $X_1$ represents a group of atoms necessary to complete an aromatic carbon ring or heterocyclic ring in which at least one of rings is composed of 5 to 7 atoms and at least one of positions adjacent to the carbon atom joined with an azo bond is a nitrogen atom or a carbon atom replaced with a chelated group. $X_2$ represents an aromatic heterocyclic ring or aromatic carbon ring in which at least one of rings is composed of 5 to 7 atoms. G represents a chelated group. The used amount of the above-mentioned dye is generally in the range of from 0.1 to 20 g per 1 $m^2$ of an ink sheet and preferably from 0.2 to 5 g.

The ratio by weight of a binder to a dye is preferably in the range of from 1:10 to 10:1 and more preferably in the range of from 2:8 to 7:3.

In the present invention, as the metal source incorporated in the metal source-containing region on the ink sheet, compounds described as metal sources which may be incorporated in the above-mentioned image-receiving layer can be employed. The added amount of the metal source in the metal source-containing region, when the metal source is incorporated in the image-receiving layer, is in the range of from 1 to 100 percent by weight of a binder and preferably in the range of from 10 to 50 percent by weight and when the metal source is not incorporated, from 10 to 250 percent by weight of the binder and preferably from 50 to 150 percent by weight. The adequate amount of the metal source in the ink sheet is selected because during the storage in roll shape, the post chelate compound is not adsorbed by a metal source transfer layer to stain images.

On the ink sheet of the metal source-containing region, various kinds of additives other than the above-mentioned compounds can be suitably added. As the additives, as mentioned above, there are illustrated lubricating compounds such as silicone resins, silicone oils (reaction hardening type available), silicone modified resins, fluororesins, surface active agents and waxes, fillers such as metal powder, silica gel, metal oxides, carbon black, resin fine particles, etc., hardening agents (for example, radiation active compounds such as isocyanates, acrylic compounds, epoxy compounds) capable of reacting with a binder constituent, etc.

The ink sheet includes the two-layer construction consisting of a support and an ink layer and also the other layer may be formed thereon. For example, with the object of preventing melt-adhesion with the image-receiving layer and dye transfer to a back side (blocking), an overcoat layer may be provided on the surface of the above-mentioned ink layer.

Furthermore, in order to improve the adhesion with the binder of an ink layer and prevent the transfer of a sublimable dye to the side of the support and dying caused by it, the support having thereon an ink sheet may have thereon a subbing layer. Further, on the back side (reverse side of the ink layer) of the support, a sticking prevention layer may be provided in order to prevent the melt-adhesion or sticking of a head to the support and the formation of wrinkles in the ink sheet. Each of the thicknesses of the above-mentioned overcoat layer, subbing layer and sticking prevention layer is from 0.1 to 1 $\mu$m.

The ink sheet can be manufactured in such a way that an ink layer-preparing coating liquid is prepared by dissolving or dispersing the above-mentioned various compositions composing an ink layer to a solvent and the resulting is coated on the surface of a support for the ink sheet employing, for example, a gravure printing process and dried. The thickness of the formed ink layer is generally in the range of from 0.2 to 10 $\mu$m and preferably in the range of from 0.3 to 3 $\mu$m.

In the present invention, the image-receiving element and/or the ink sheet may have an antistatic function. In order to enable it to have the antistatic function, conventionally known techniques can be employed. Namely, there can be employed electrically conductive substances such as metals, metal oxides, carbon fine particles, etc., organic compounds termed "antistatic agent" (cation, anion, amphoion or nonion surface active agents or polysiloxans, etc.), electronically conductive inorganic fine particles (fine particles of titanium oxide, zinc oxide, indium oxide, etc. are mixed with impurities and sintered to enhance electronic conductivity disturbing crystal lattice and those which undergo doping treatment.), etc. The electrically conductive substances such as mentioned above may be incorporated into at least one of layers constructing the image-receiving element and/or the ink sheet and at least one layer may be formed as an electrically conductive layer prepared by coating a paint comprising an electrically conductive substance. Naturally, combinations of those are preferably employed.

When the electrically conductive substance such as those mentioned above are employed to prepare an electrically conductive layer, electrically conductive paint can be prepared by a conventional method. However, preferably, the antistatic agents are employed in the form of alcohol solution or aqueous solution; electronically conductive inorganic fine particles are employed as they are; the former is dissolved or dispersed in a solution comprising an organic solvent for a resin to be used as a binder and the latter is dispersed.

Resins to be used as a binder for the electrically conductive paint are preferably thermosetting resins such as thermosetting polyacrylic acid ester resins, polyurethane resins, etc., or thermoplastic resins such as polyvinyl chloride, polyvinyl butyral resins, polyester resins, etc. Further, the ratio of the binder to the electrically conductive substance is preferably determined so that the surface specific resistance of the electrically conductive layer after coating and drying (after thermosetting in certain cases) becomes 1° C. $10^{10}$ Ωcm or less.

The prepared electrically conductive paint can be coated employing an ordinary coating method such as, for example, blade coating, gravure coater, etc. and spray coating.

When a static charge processing capability is rendered by providing an electrically conductive layer on a paper substrate, the aqueous solution of the antistatic agent is preferably coated, or the above-mentioned electronically conductive inorganic fine powders are dispersed or dissolved in aqueous paints such as synthetic resin emulsion, synthetic rubber latex, aqueous solution of a water-soluble resin, etc. and the resulting is preferably coat dried to form the dried layer. As the synthetic resin emulsions, there are exemplified emulsions of polyacrylic acid ester resin or polyurethane resin, etc., and as the synthetic rubber latex, there are exemplified rubber such as methylmethacrylate-butadiene, stylene-butadinene, etc., and as the aqueous solution of the water-soluble resin, aqueous solutions of polyvinyl alcohol resin, polyacrylamide resin, starch, etc. Or more simply, the aqueous solution of an antistatic agent may be spray coated.

Furthermore, as another preferred embodiment, when an antistatic layer is provided on the image-receiving element, or a core material or base material, an antistatic layer composed of the antistatic resins consisting of an acrylic resin and epoxy resin as described in Japanese Patent Publication Open to Public Inspection No. 8-52945.

Such the antistatic layer can be formed by coating employing a conventional method a coating solution prepared by mixing the above-mentioned main agent and a hardening agent in a proper ratio on at least one side of the core material or base material of the ink sheet and/or image-receiving element or a primer or adhesive layer provided on those. The antistatic layer is provided on the surface of a core material or base material forming the ink layer or image-receiving layer and on that the ink layer or the image-receiving layer may be provided and may be also provided on the surface of the reverse side of the side on which the ink layer or image-receiving layer is formed. Furthermore, another layer on the side of the antistatic layer, for example, a heat resistant slipping layer or back side slipping layer, etc. may be provided. As the coating method, a conventionally used coating method may be employed.

When the antistatic agent is employed in the image-receiving layer, it is preferably soluble in organic solvent. As the antistatic agents soluble in the organic, those described in Japanese Patent Publication Open to Public Inspection No. 5-64979 are illustrated.

When the above-mentioned antistatic agent is incorporated into the image-receiving layer, the added amount is preferably in the range of 0.1 to 10 parts by weight per 100 parts by weight of the resin forming the image-receiving layer. When the used amount is too little, antistatic effect becomes insufficient, and on the other hand, the excessive amount is not preferred because the dye acceptability of the image-receiving layer and image preservation quality is degraded. In addition, the preferred distribution of the antistatic agent in the direction of the thickness of the image-receiving layer is that 50 weight percent of the antistatic agent is incorporated within ⅕ thickness from the surface of the image-receiving layer. When constructed as mentioned above, excellent antistatic property is consistently offered, though dye transfer to the same region of the image-receiving layer is carried out a plurality of times. Further, in order to construct as mentioned above, the image-receiving layer is prepared by slow drying condition and the antistatic agent having a smaller molecular weight than that of a resin is preferably distributed densely at the surface region of the image-receiving layer.

The ink layer of the present invention may incorporate a low molecular substance having a melting point of 50 to 150° C. as a sensitizer. The sensitizer having the melting point of lower than 50° C. is not preferred because it tends to move to the surface of the ink layer and on the other hand, the sensitizer having the melting point of higher than 150° C. is not preferred because the sensitizing action decreases sharply.

Furthermore, the molecular weight of the sensitizer is preferably in the range of 100 to 1,500. The sensitizer having the molecular weight of less than 100 is not preferred because its melting point is generally lower than 50° C. On the other hand, the sensitizer having the molecular weight of larger than 1,500 is also not preferred because the fusion sharpness is lost and the sensitizing action becomes insufficient.

Furthermore, the used amount of the above-mentioned sensitizer is preferably in the range of 1 to 100 parts by weight per 100 parts by weight of the binder employed to form the ink layer. The used amount of less than 1 part by weight is not preferred because no satisfactory sensitizing action is obtained. On the other hand, the used amount exceeding 100 parts by weight is not preferred because the thermal resistance of the ink layer decreases.

As sensitizers such as mentioned above, those having a low molecular weight known in the art are available as far as those have a melting point of 50 to 150° C. However, as those preferred, there are illustrated thermoplastic oligomers, for example, various kinds of oligomers such as polyurethane oligomer, polystyrene oligomer, polyester oligomer, polyacryl oligomer, polyethylene oligomer, polyvinyl chloride oligomer, polyvinyl acetate oligomer, ethylene/vinyl acetate copolymer oligomer, ethyleneacryl copolymer oligomer, polyoxyethylene oligomer, polyoxypropylene oligomer, polyoxyethylenepropylene oligomer, etc., fatty acids such as myristic acid, palmitic acid, margaric acid, stearic acid, arachic acid, montanic acid, etc., fatty acid amides such as caproic acid amide, caprylic acid amide, lauric acid amide, stearic acid amide, oleic acid amide, eicosanic acid amide, etc., fatty acid esters such as methyl behenate, pentadecyl palmitate, hexacocyl stearate, [1,4-phnylenebis(methylene)]bisdimethyl carbamate, etc., and aromatic compounds such as 1,4-dicyclohexylbenzene, benzoic acid, aminobenzophenone, dimetylterephthalate, fuluorantene, phenols, naphthalenes, phenoxys, various waxes, etc.

In the image forming method of the present invention, as a heating device employed to transfer the dye and metal source incorporated in the ink layer on the ink sheet to the image-receiving layer of the image-receiving element, known heating devices such as a heat press, hot stamping method, etc. utilizing a thermal head, heat roller, a metal plate, heat resistant silicone rubber, etc. can be employed. As the heating device, the thermal head or heat roller is preferably employed in terms of the size and simplicity.

Figure 2:
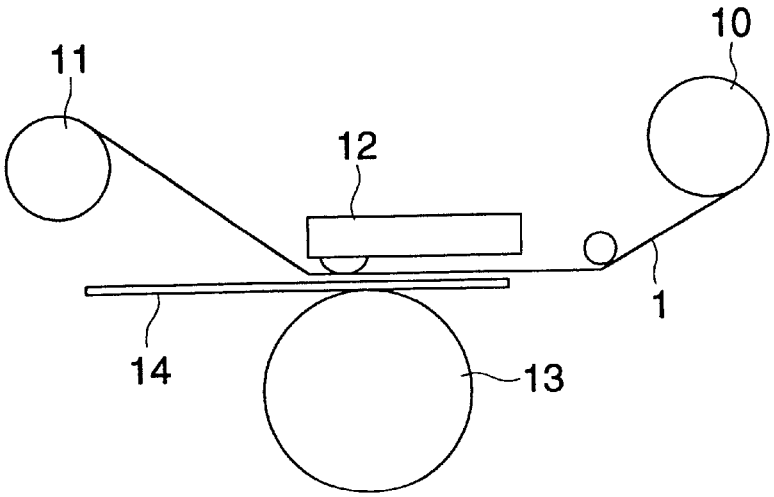
FIG. 2 is a schematic diagram of one example of a heat transfer recording apparatus employed in the present invention.

As a thermal transfer recording apparatus, for example, the apparatus shown in FIG. 2 can be employed. In FIG. 2, the reference numeral 10 is an ink sheet supply roll, 1 is an ink sheet, 11 is a winding roll which winds a used ink sheet, 12 is a thermal head, 13 is a platen roller and 14 is an image-receiving element inserted between the thermal head 12 and the platen roller 13.

While employing the thermal transfer apparatus shown in FIG. 2, for forming a transfer image employing, for example, the ink sheet shown in FIG. 1 as an ink sheet, at first, an yellow dye-containing region 1Y of the ink sheet 1 the image-receiving layer of the image-receiving element are brought into contact and the yellow in the ink layer of the aforesaid region is heated by the thermal head in accordance with image data and transferred to the image-receiving element to form the yellow image; thereafter, in the same way, the magenta dye is transferred imagewise from the ink layer of the magenta dye-containing region 1M to the yellow image; thereafter, in the same way, the cyan dye is transferred imagewise from the ink layer of the cyan dye-containing region 1C to the resulting image; lastly, the formation of the transfer image is completed by transferring the metal source of the ink layer of the metal source-containing region 1*a* to the whole area of the resulting image.

In the present invention, the transfer of the metal source can take the following embodiments (1) to (3).

The metal source is:

(1) transferred uniformly to whole area of image.

(2) transferred uniformly to the area where the dye has been transferred.

(3) transferred in such a way that the amount of the metal source to be transferred is controlled so as to match the amount of the transferred dye.

The hue of the image-receiving layer in the above-mentioned embodiments is as follows. In terms of the quality of white background, (2) is better than (2); (3) is better than (2) and further, in terms of easiness in control, the order is (1), (2) and (3) and (1) is easiest.

EXAMPLE

Next, the present invention is specifically explained with reference to Examples. Moreover, "parts" in Example are "by weight".

Example 1

Preparation of Ink Sheet

Each ink layer composed of the following composition of yellow, magenta cyan and a metal source-containing ink layer were coated (thickness of 1 μm after drying) on the back side of a heat resistant protective layer of polyethylene terephthalate film (Rumilar 6CF531 manufactured by Toray Industries, Inc.) having a thickness of 6 μm and the above-mentioned protective layer by a gravure method, and the ink sheet was prepared in which each ink layer of yellow, magenta and cyan, and the metal source-containing layer are arranged in order (hereinafter referred to as "face order") as shown in FIG. 1.

| | |
|---|---|
| Yellow Ink Layer | |
| Post chelate dye Y-1 mentioned below | 20 parts |
| Polyvinyl acetal (KY-24 manufactured by Denki Kagaku Kogyo K. K.) | 80 parts |
| Magenta Ink Layer | |
| Post chelate dye M-1 mentioned below | 20 parts |
| Polyvinyl acetal (KY-24 manufactured by Denki Kagaku Kogyo K. K.) | 80 parts |
| Cyan Ink Layer | |
| Post chelate dye mentioned below | 20 parts |
| Polyvinyl acetal (KY-24 manufactured by Denki Kagaku Kogyo, K. K.) | 80 parts |
| Metal Source-containing Ink Layer | |
| $Ni^{2+}(NH_2COCH_2NH_2)_3.2B(C_6H_5)_4^-$(metal source (MS-1)) | amount described in Table 2 |
| Polyvinyl acetal (KY-24 manufactured by Denki Kagaku Kogyo K. K.) | amount described in Table 2 |

Post chelate dye Y-1

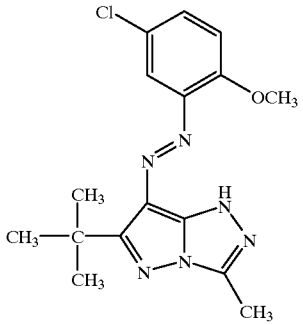

Post chelate dye M-1

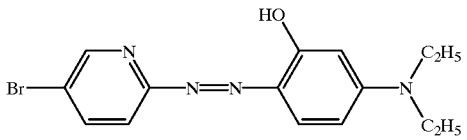

Post chelate dye C-1

-continued

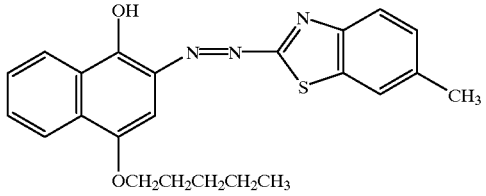

Preparation of Image-receiving Element

An anchor layer and an image-receiving layer having compositions described below were coated in this order on the front side of synthetic paper (YUPO manufactured by Oji Yuka Co.) having a thickness of 175 μm to form the image-receiving layer having a thickness of the anchor layer of 0.5 μm and of the image-receiving layer of 4 μm and an image-receiving sheet as an image-receiving element was prepared.

| | |
|---|---|
| Anchor Layer | |
| Polyvinyl butyral (Esrex BL-1 manufactured by Sekisui Chemical Co., Ltd.) | 90 parts |
| Isocyanate (Coronate HX manufactured by Nippon Polyurethane Kogyo Co., Ltd.) | 10 parts |
| Image-receiving Layer | |
| Polyvinylbutyral (Esrex BX-1 manufactured by Sekisui Chemical Co., Ltd.) | amount described in Table 2 |
| Above-mentioned metal source (MS-1) | amount described in Table 2 |
| Polyester modified silicone (X-24-8300 manufactured by Shin-Etsu Chemical Co., Ltd.) | 0.5 part |

Image Formation

With the use of an A4 sublimable thermal transfer line printer, solid yellow, magenta and cyan images are formed and furthermore, with the use of the head of the same printer, yellow, magenta and cyan images having a density of 1.0 was prepared via the metal source-containing layer upon heating.

Evaluation on Light Fastness of Images.

Each of the above-mentioned images was subjected to exposure by a xenon fademeter (70,000 lux) for 14 days and each density was measured to obtain a density remaining ratio. The results are shown in Table 2 below.

In addition, the chelation ratio was obtained according to the absorption spectrum of each image. The value is tabulated in Table 2 below.

TABLE 2

| Sample No. | Metal Source-containing Layer MS-1 in part | KY-24 in part | Image-receiving Layer MS-1 in part | BX-1 in part | Density Remaining Ratio Y % | M % | C % | Chelation Ratio Y % | M % | C % | Hue of Image-receiving Layer |
|---|---|---|---|---|---|---|---|---|---|---|---|
| 1-1 | 1 | 99 | 49.5 | 50 | 99 | 96 | 96 | 99 | 99 | 99 | B |
| 1-2 | 5 | 95 | 49.5 | 50 | 99 | 96 | 96 | 99 | 99 | 99 | B |
| 1-3 | 1 | 99 | 39.5 | 60 | 99 | 95 | 96 | 99 | 99 | 99 | B |
| 1-4 | 5 | 95 | 39.5 | 60 | 99 | 95 | 96 | 99 | 99 | 99 | B |
| 1-5 | 10 | 90 | 39.5 | 60 | 99 | 95 | 96 | 99 | 99 | 99 | B |
| 1-6 | 1 | 99 | 31.5 | 68 | 99 | 95 | 96 | 99 | 99 | 99 | A |
| 1-7 | 5 | 95 | 31.5 | 68 | 99 | 95 | 96 | 99 | 99 | 99 | A |
| 1-8 | 10 | 90 | 31.5 | 68 | 99 | 95 | 96 | 99 | 99 | 99 | A |
| 1-9 | 1 | 99 | 22 | 77.5 | 99 | 94 | 95 | 99 | 99 | 99 | A |
| 1-10 | 5 | 95 | 22 | 77.5 | 99 | 95 | 96 | 99 | 99 | 99 | A |
| 1-11 | 10 | 90 | 22 | 77.5 | 99 | 95 | 96 | 99 | 99 | 99 | A |
| 1-12 | 1 | 99 | 11.5 | 88 | 98 | 92 | 93 | 98 | 97 | 97 | A |
| 1-13 | 5 | 95 | 11.5 | 88 | 98 | 93 | 94 | 98 | 98 | 97 | A |
| 1-14 | 10 | 90 | 11.5 | 88 | 99 | 94 | 95 | 99 | 99 | 98 | A |
| 1-15 | 20 | 80 | 11.5 | 88 | 99 | 95 | 96 | 99 | 99 | 99 | A |
| 1-16 | 1 | 99 | 6.5 | 93 | 98 | 91 | 92 | 97 | 97 | 96 | A |
| 1-17 | 5 | 95 | 6.5 | 93 | 98 | 92 | 93 | 98 | 97 | 97 | A |
| 1-18 | 10 | 90 | 6.5 | 93 | 98 | 93 | 94 | 98 | 98 | 97 | A |
| 1-19 | 20 | 80 | 6.5 | 93 | 99 | 94 | 95 | 99 | 99 | 98 | A |
| 1-20 | 0 | 100 | 49.5 | 50 | 99 | 90 | 92 | 95 | 96 | 95 | B |
| 1-21 | 0 | 100 | 39.5 | 60 | 98 | 88 | 90 | 94 | 95 | 94 | B |
| 1-22 | 0 | 100 | 22 | 77.5 | 88 | 80 | 82 | 90 | 85 | 85 | A |
| 1-23 | 0 | 100 | 11.5 | 88 | 40 | 34 | 37 | 40 | 38 | 37 | A |
| 1-24 | 0 | 100 | 0 | 99.5 | 12 | 18 | 14 | 0 | 0 | 0 | A |

Example 2

On the corona-discharged surface of polyethylene terephthalate film having a thickness of 6 μm as a support, each ink layer of yellow, magenta and cyan have compositions below and a metal source-containing layer were coated by a gravure method so as to obtain the dried thickness of 1 μm and the ink sheet was obtained in which each ink layer of yellow, magenta and cyan and the metal source-containing layer were formed in order (hereinafter referred to as "face order") in FIG. 1. Furthermore, on the side without the corona discharging, silicone oil (X-4, 403A manufactured by Shin-Etsu Silicone Co., Ltd.) was dropped using a syringe and spread to whole area, and a back side treatment coating was performed.

| | |
|---|---|
| Yellow Ink Layer | |
| Above-mentioned post chelate dye Y-1 | 30 parts |
| Polyvinyl acetal (Denkabutyral KY-24 manufactured by Denki Kagaku Kogyo K. K.) | 55 parts |
| Polymethylmethacrylate (Rezeda GP-200 manufactured by Toagosei Co., Ltd.) | 10 parts |
| Urethane modified silicone oil (Diaroma SP-2105 manufactured by Dainichiseika Colour & Chemicals Mfg. Co., Ltd.) | 5 parts |
| Magenta Ink Layer | |
| Above-mentioned post chelate dye M-1 | 20 parts |
| Polyvinyl acetal (Denkabutyral KY-24 manufactured by Denki Kagaku Kogyo K. K.) | 55 parts |
| Polymethylmethacrylate (Rezeda GP-200 manufactured by Toagosei Co., Ltd.) | 20 parts |
| Urethane modified silicone oil (Diaroma SP-2105 manufactured by Dainichiseika Colour & Chemicals Mfg. Co., Ltd.) | 5 parts |
| Cyan Ink Layer | |
| Above-mentioned post chelate dye C-1 | 30 parts |
| Polyvinyl acetal (Denkabutyral KY-24 manufactured by Denki Kagaku Kogyo K. K.) | 55 parts |
| Polymethylmethacrylate (Rezeda GP-200 manufactured by Toagosei Co., Ltd.) | 10 parts |
| Urethane modified silicone oil (Diaroma SP-2105 manufactured by Dainichiseika Colour & Chemicals Mfg. Co., Ltd.) | 5 parts |
| Metal Source-containing Ink Layer | |
| $Ni^{2+}$ $(NH_2COCH_2NH_2)_3.2B(C_6H_5)_4^-$ (metal source (MS-1)) | amount described in Table 3 |
| Polyvinyl acetal (KY-24 manufactured by Denki Kagaku Kogyo K. K.) | amount described in Table 3 |
| Polymethylmethacrylate (Rezeda GP-200 manufactured by Toagosei Co., Ltd.) | amount described in Table 3 |
| Urethane modified silicone oil (Diaroma SP-2105 manufactured by Dainichiseika Colour & Chemicals Mfg. Co., Ltd.) | 5 parts |

Preparation of Image-receiving Element

On the surface of a synthetic paper (YUPO manufactured by Oji Yuka Co., Ltd.), a first image-receiving layer, a second image-receiving layer and a third image-receiving layer having compositions below were coated in this order so as to result in thickness of 0.2 μm, 3.0 μm and 0.5 μm, respectively and thus the image-receiving sheet as the image-receiving element was prepared.

| First Image-receiving Layer | |
|---|---|
| Polyvinyl butyral resin (Esulex BL-1 manufactured by Sekisui Chemical Co., Ltd.) | 90 parts |
| Isocyanate (Coronate HX manufactured by Nippon Polyurethane Kogyo Co., Ltd.) | 10 parts |
| **Second Image-receiving Layer** | |
| Polyvinyl butyral resin (Esulex BX-1 manufactured by Sekisui Chemical Co., Ltd.) | amount described in Table 3 |
| Above-mentioned metal source (MS-1) | 40 parts |
| **Third Image-receiving Layer** | |
| Polyethylene wax emulsion (Hitech E-1000 manufactured by Toho Chemical Industry Co., Ltd.) | 20 parts |
| Urethane-modified ethyleneacrylate acid polymer emulsion (S-6254 manufactured by Toho Chemical Industry Co., Ltd.) | 79 parts |
| Hydroxyethyl cellulose | 1 part |

Image Formation

With the use of an A4 sublimation thermal transfer line printer, solid yellow, magenta and cyan images are formed and furthermore, with the use of the head of the same printer, yellow, magenta and cyan images having a density of 1.0 were prepared via the metal source-containing layer upon heating.

The light fastness and chelation ratio of the above-mentioned images were measured with the same method in Example 1.

Furthermore, in regard to the hue of the image-receiving layer, the hue of the white background of the sample was visually evaluated. The results are shown in Table 3 below.

In Table 3 and Tables thereafter, marks in the column of the Hue of Image-receiving Layer signify as follows.

A: hue of a metal source is not detected. Preferred as white background.

B: hue of a metal source is somewhat detected (pale green in the present Example and Control, and Examples and Controls thereafter). However, there is no problem for practical use.

C: hue of a metal source is definitely detected and makes it impossible to put into practical use.

Example 3

An ink sheet was prepared in the same manner as in Example 2 except that each ink layer forming each one region of yellow, magenta and cyan is changed into a single color ink of one region having the compositions below and the image formation (gray having a density of 1.0) and the image evaluation were carried out. Table 4 shows the results.

| Single Color Ink Layer | |
|---|---|
| Post chelate dye Y-1 | 10 parts |
| Post chelate dye M-1 | 7 parts |
| Post chelate dye C-1 | 13 parts |
| Polyvinyl acetal (Denkabutyral Ky-24 manufactured by Denki Kagaku Kogyo K. K.) | 55 PARTS |
| Polymethylmethacrylate (Rezeda GP-200 manufactured by Toagosei Co., Ltd.) | 10 parts |
| Urehtane-modified silicone oil (Diaroma SP-2105 manufactured by Dainichiseika Colour & Chemicals Mfg. Co., Ltd.) | 5 parts |

TABLE 3

| | Metal Source-containing Layer | | | Image-receiving Layer | | Density Remaining Ratio | | | Chelation Ratio | | | Hue of Image- |
|---|---|---|---|---|---|---|---|---|---|---|---|---|
| Sample No. | MS-1 in part | KY-24 in part | GP-200 in part | MS-1 in part | BX-1 in part | Y % | M % | C % | Y % | M % | C % | receiving Layer |
| 2-1 | 1 | 62.7 | 31.3 | 49.5 | 50.5 | 99 | 96 | 96 | 99 | 99 | 99 | B |
| 2-2 | 5 | 60.0 | 30.0 | 49.5 | 50.5 | 99 | 96 | 96 | 99 | 99 | 99 | B |
| 2-3 | 1 | 62.7 | 31.3 | 39.5 | 60.5 | 99 | 95 | 96 | 99 | 99 | 99 | B |
| 2-4 | 5 | 60.0 | 30.0 | 39.5 | 60.5 | 99 | 95 | 96 | 99 | 99 | 99 | B |
| 2-5 | 10 | 56.7 | 28.3 | 39.5 | 60.5 | 99 | 95 | 96 | 99 | 99 | 99 | B |
| 2-6 | 1 | 62.7 | 31.3 | 31.5 | 68.5 | 99 | 95 | 96 | 99 | 99 | 99 | A |
| 2-7 | 5 | 60.0 | 30.0 | 31.5 | 68.5 | 99 | 95 | 96 | 99 | 99 | 99 | A |
| 2-8 | 10 | 56.7 | 28.3 | 31.5 | 68.5 | 99 | 95 | 96 | 99 | 99 | 99 | A |
| 2-9 | 1 | 62.7 | 31.3 | 22 | 78 | 99 | 94 | 95 | 99 | 99 | 99 | A |
| 2-10 | 5 | 60.0 | 30.0 | 22 | 78 | 99 | 95 | 96 | 99 | 99 | 99 | A |
| 2-11 | 10 | 56.7 | 28.3 | 22 | 78 | 99 | 95 | 96 | 99 | 99 | 99 | A |
| 2-12 | 1 | 62.7 | 31.3 | 11.5 | 88.5 | 98 | 92 | 93 | 98 | 97 | 97 | A |
| 2-13 | 5 | 60.0 | 30.0 | 11.5 | 88.5 | 98 | 93 | 94 | 98 | 98 | 97 | A |
| 2-14 | 10 | 56.7 | 28.3 | 11.5 | 88.5 | 99 | 94 | 95 | 99 | 99 | 98 | A |
| 2-15 | 20 | 50.0 | 25.0 | 11.5 | 88.5 | 99 | 95 | 96 | 99 | 99 | 99 | A |
| 2-16 | 1 | 62.7 | 31.3 | 6.5 | 93.5 | 98 | 91 | 92 | 97 | 97 | 96 | A |
| 2-17 | 5 | 60.0 | 30.0 | 6.5 | 93.5 | 98 | 92 | 93 | 98 | 97 | 97 | A |
| 2-18 | 10 | 56.7 | 28.3 | 6.5 | 93.5 | 98 | 93 | 94 | 98 | 98 | 97 | A |
| 2-19 | 20 | 50.0 | 25.0 | 6.5 | 93.5 | 99 | 94 | 95 | 99 | 99 | 98 | A |
| 2-20 | 0 | 63.3 | 31.7 | 49.5 | 50.5 | 99 | 90 | 92 | 95 | 96 | 95 | B |
| 2-21 | 0 | 63.3 | 31.7 | 39.5 | 60.5 | 98 | 88 | 90 | 94 | 95 | 94 | B |
| 2-22 | 0 | 63.3 | 31.7 | 22 | 78 | 88 | 80 | 82 | 90 | 85 | 85 | A |
| 2-23 | 0 | 63.3 | 31.7 | 11.5 | 88.5 | 40 | 34 | 37 | 40 | 38 | 37 | A |
| 2-24 | 0 | 63.3 | 31.7 | 0 | 100 | 12 | 18 | 14 | 0 | 0 | 0 | A |

The results are shown in Table 4.

TABLE 4

| Sample No. | Metal Source-containing Layer MS-1 in part | KY-24 in part | GP-200 in part | Image-receiving Layer MS-1 in part | BX-1 in part | Density Remaining Ratio Y % | M % | C % | Chelation Ratio Y % | M % | C % | Hue of Image-receiving Layer |
|---|---|---|---|---|---|---|---|---|---|---|---|---|
| 3-1 | 1 | 62.7 | 31.3 | 49.5 | 50.5 | 99 | 96 | 96 | 99 | 99 | 99 | B |
| 3-2 | 5 | 60.0 | 30.0 | 49.5 | 50.5 | 99 | 96 | 96 | 99 | 99 | 99 | B |
| 3-3 | 1 | 62.7 | 31.3 | 39.5 | 60.5 | 99 | 95 | 96 | 99 | 99 | 99 | B |
| 3-4 | 5 | 60.0 | 30.0 | 39.5 | 60.5 | 99 | 95 | 96 | 99 | 99 | 99 | B |
| 3-5 | 10 | 56.7 | 28.3 | 39.5 | 60.5 | 99 | 95 | 96 | 99 | 99 | 99 | B |
| 3-6 | 1 | 62.7 | 31.3 | 31.5 | 68.5 | 99 | 95 | 96 | 99 | 99 | 99 | A |
| 3-7 | 5 | 60.0 | 30.0 | 31.5 | 68.5 | 99 | 95 | 96 | 99 | 99 | 99 | A |
| 3-8 | 10 | 56.7 | 28.3 | 31.5 | 68.5 | 99 | 95 | 96 | 99 | 99 | 99 | A |
| 3-9 | 1 | 62.7 | 31.3 | 22 | 78 | 99 | 94 | 95 | 99 | 99 | 99 | A |
| 3-10 | 5 | 60.0 | 30.0 | 22 | 78 | 99 | 95 | 96 | 99 | 99 | 99 | A |
| 3-11 | 10 | 56.7 | 28.3 | 22 | 78 | 99 | 95 | 96 | 99 | 99 | 99 | A |
| 3-12 | 1 | 62.7 | 31.3 | 11.5 | 88.5 | 98 | 92 | 93 | 98 | 97 | 97 | A |
| 3-13 | 5 | 60.0 | 30.0 | 11.5 | 88.5 | 98 | 93 | 94 | 98 | 98 | 97 | A |
| 3-14 | 10 | 56.7 | 28.3 | 11.5 | 88.5 | 99 | 94 | 95 | 99 | 99 | 98 | A |
| 3-15 | 20 | 50.0 | 25.0 | 11.5 | 88.5 | 99 | 95 | 96 | 99 | 99 | 99 | A |
| 3-16 | 1 | 62.7 | 31.3 | 6.5 | 93.5 | 98 | 91 | 92 | 97 | 97 | 96 | A |
| 3-17 | 5 | 60.0 | 30.0 | 6.5 | 93.5 | 98 | 92 | 93 | 98 | 97 | 97 | A |
| 3-18 | 10 | 56.7 | 28.3 | 6.5 | 93.5 | 98 | 93 | 94 | 98 | 98 | 97 | A |
| 3-19 | 20 | 50.0 | 25.0 | 6.5 | 93.5 | 99 | 94 | 95 | 99 | 99 | 98 | A |
| 3-20 | 0 | 63.3 | 31.7 | 49.5 | 50.5 | 99 | 90 | 92 | 95 | 96 | 95 | B |
| 3-21 | 0 | 63.3 | 31.7 | 39.5 | 60.5 | 98 | 88 | 90 | 94 | 95 | 94 | B |
| 3-22 | 0 | 63.3 | 31.7 | 22 | 78 | 88 | 80 | 82 | 90 | 85 | 85 | A |
| 3-23 | 0 | 63.3 | 31.7 | 11.5 | 88.5 | 40 | 34 | 37 | 40 | 38 | 37 | A |
| 3-24 | 0 | 63.3 | 31.7 | 0 | 100 | 12 | 18 | 14 | 0 | 0 | 0 | A |

Example 4

An ink sheet was prepared in the same manner as in Example 2 except that the single color layer of Example 3 was provided between the cyan ink layer and the metal source-containing ink layer and the image formation and evaluation were carried out. The results are shown in Table 5.

Example 5

An ink sheet was prepared in the same manner as in Example 2 except that the composition of the image-receiving element is changed to that below and the image formation and evaluation were carried out. Namely, on the surface of a synthetic paper (YUPO manufactured by Oji Yuka Co., Ltd.) having a thickness of 175 μm, a first

TABLE 5

| Sample No. | Metal Source-containing Layer MS-1 in part | KY-24 in part | GP-200 in part | Image-receiving Layer MS-1 in part | BX-1 in part | Density Remaining Ratio Y % | M % | C % | Chelation Ratio Y % | M % | C % | Hue of Image-receiving Layer |
|---|---|---|---|---|---|---|---|---|---|---|---|---|
| 4-1 | 1 | 62.7 | 31.3 | 49.5 | 50.5 | 99 | 96 | 96 | 99 | 99 | 99 | B |
| 4-2 | 5 | 60.0 | 30.0 | 49.5 | 50.5 | 99 | 96 | 96 | 99 | 99 | 99 | B |
| 4-3 | 1 | 62.7 | 31.3 | 39.5 | 60.5 | 99 | 95 | 96 | 99 | 99 | 99 | B |
| 4-4 | 5 | 60.0 | 30.0 | 39.5 | 60.5 | 99 | 95 | 96 | 99 | 99 | 99 | B |
| 4-5 | 10 | 56.7 | 28.3 | 39.5 | 60.5 | 99 | 95 | 96 | 99 | 99 | 99 | B |
| 4-6 | 1 | 62.7 | 31.3 | 31.5 | 68.5 | 99 | 95 | 96 | 99 | 99 | 99 | A |
| 4-7 | 5 | 60.0 | 30.0 | 31.5 | 68.5 | 99 | 95 | 96 | 99 | 99 | 99 | A |
| 4-8 | 10 | 56.7 | 28.3 | 31.5 | 68.5 | 99 | 95 | 96 | 99 | 99 | 99 | A |
| 4-9 | 1 | 62.7 | 31.3 | 22 | 78 | 99 | 94 | 95 | 99 | 99 | 99 | A |
| 4-10 | 5 | 60.0 | 30.0 | 22 | 78 | 99 | 95 | 96 | 99 | 99 | 99 | A |
| 4-11 | 10 | 56.7 | 28.3 | 22 | 78 | 99 | 95 | 96 | 99 | 99 | 99 | A |
| 4-12 | 1 | 62.7 | 31.3 | 11.5 | 88.5 | 98 | 92 | 93 | 98 | 97 | 97 | A |
| 4-13 | 5 | 60.0 | 30.0 | 11.5 | 88.5 | 98 | 93 | 94 | 98 | 98 | 97 | A |
| 4-14 | 10 | 56.7 | 28.3 | 11.5 | 88.5 | 99 | 94 | 95 | 99 | 99 | 98 | A |
| 4-15 | 20 | 50.0 | 25.0 | 11.5 | 88.5 | 99 | 95 | 96 | 99 | 99 | 99 | A |
| 4-16 | 1 | 62.7 | 31.3 | 6.5 | 93.5 | 98 | 91 | 92 | 97 | 97 | 96 | A |
| 4-17 | 5 | 60.0 | 30.0 | 6.5 | 93.5 | 98 | 92 | 93 | 98 | 97 | 97 | A |
| 4-18 | 10 | 56.7 | 28.3 | 6.5 | 93.5 | 98 | 93 | 94 | 98 | 98 | 97 | A |
| 4-19 | 20 | 50.0 | 25.0 | 6.5 | 93.5 | 99 | 94 | 95 | 99 | 99 | 98 | A |
| 4-20 | 0 | 63.3 | 31.7 | 49.5 | 50.5 | 99 | 90 | 92 | 95 | 96 | 95 | B |
| 4-21 | 0 | 63.3 | 31.7 | 39.5 | 60.5 | 98 | 88 | 90 | 94 | 95 | 94 | B |
| 4-22 | 0 | 63.3 | 31.7 | 22 | 78 | 88 | 80 | 82 | 90 | 85 | 85 | A |
| 4-23 | 0 | 63.3 | 31.7 | 11.5 | 88.5 | 40 | 34 | 37 | 40 | 38 | 37 | A |
| 4-24 | 0 | 63.3 | 31.7 | 0 | 100 | 12 | 18 | 14 | 0 | 0 | 0 | A |

image-receiving layer and a second image-receiving layer were coated in this order so as to result in the thickness of 0.5 μm and 4.0 μm and the image-receiving sheet as the image-receiving element was obtained. The results are shown in Table 6.

TABLE 6

| | Metal Source-containing Layer | | | Image-receiving Layer | | Density Remaining Ratio | | | Chelation Ratio | | | Hue of Image- |
|---|---|---|---|---|---|---|---|---|---|---|---|---|
| Sample No. | MS-1 in part | KY-24 in part | GP-200 in part | MS-1 in part | BX-1 in part | Y % | M % | C % | Y % | M % | C % | receiving Layer |
| 5-1 | 1 | 62.7 | 31.3 | 49.5 | 50.5 | 99 | 96 | 96 | 99 | 99 | 99 | B |
| 5-2 | 5 | 60.0 | 30.0 | 49.5 | 50.5 | 99 | 96 | 96 | 99 | 99 | 99 | B |
| 5-3 | 1 | 62.7 | 31.3 | 39.5 | 60.5 | 99 | 95 | 96 | 99 | 99 | 99 | B |
| 5-4 | 5 | 60.0 | 30.0 | 39.5 | 60.5 | 99 | 95 | 96 | 99 | 99 | 99 | B |
| 5-5 | 10 | 56.7 | 28.3 | 39.5 | 60.5 | 99 | 95 | 96 | 99 | 99 | 99 | B |
| 5-6 | 1 | 62.7 | 31.3 | 31.5 | 68.5 | 99 | 95 | 96 | 99 | 99 | 99 | A |
| 5-7 | 5 | 60.0 | 30.0 | 31.5 | 68.5 | 99 | 95 | 96 | 99 | 99 | 99 | A |
| 5-8 | 10 | 56.7 | 28.3 | 31.5 | 68.5 | 99 | 95 | 96 | 99 | 99 | 99 | A |
| 5-9 | 1 | 62.7 | 31.3 | 22 | 78 | 99 | 94 | 95 | 99 | 99 | 99 | A |
| 5-10 | 5 | 60.0 | 30.0 | 22 | 78 | 99 | 95 | 96 | 99 | 99 | 99 | A |
| 5-11 | 10 | 56.7 | 28.3 | 22 | 78 | 99 | 95 | 96 | 99 | 99 | 99 | A |
| 5-12 | 1 | 62.7 | 31.3 | 11.5 | 88.5 | 98 | 92 | 93 | 98 | 97 | 97 | A |
| 5-13 | 5 | 60.0 | 30.0 | 11.5 | 88.5 | 98 | 93 | 94 | 98 | 98 | 97 | A |
| 5-14 | 10 | 56.7 | 28.3 | 11.5 | 88.5 | 99 | 94 | 95 | 99 | 99 | 98 | A |
| 5-15 | 20 | 50.0 | 25.0 | 11.5 | 88.5 | 99 | 95 | 96 | 99 | 99 | 99 | A |
| 5-16 | 1 | 62.7 | 31.3 | 6.5 | 93.5 | 98 | 91 | 92 | 97 | 97 | 96 | A |
| 5-17 | 5 | 60.0 | 30.0 | 6.5 | 93.5 | 98 | 92 | 93 | 98 | 97 | 97 | A |
| 5-18 | 10 | 56.7 | 28.3 | 6.5 | 93.5 | 98 | 93 | 94 | 98 | 98 | 97 | A |
| 5-19 | 20 | 50.0 | 25.0 | 6.5 | 93.5 | 99 | 94 | 95 | 99 | 99 | 98 | A |
| 5-20 | 0 | 63.3 | 31.7 | 49.5 | 50.5 | 99 | 90 | 92 | 95 | 96 | 95 | B |
| 5-21 | 0 | 63.3 | 31.7 | 39.5 | 60.5 | 98 | 88 | 90 | 94 | 95 | 94 | B |
| 5-22 | 0 | 63.3 | 31.7 | 22 | 78 | 88 | 80 | 82 | 90 | 85 | 85 | A |
| 5-23 | 0 | 63.3 | 31.7 | 11.5 | 88.5 | 40 | 34 | 37 | 40 | 38 | 37 | A |
| 5-24 | 0 | 63.3 | 31.7 | 0 | 100 | 12 | 18 | 14 | 0 | 0 | 0 | A |

| | |
|---|---|
| **First Image-receiving Layer** | |
| Polyvinyl butyral resin (Eslex BL-1 manufactured by Sekisui Chemical Co., Ltd.) | 90 parts |
| Isocyanate (Coronate HX manufactured by Nippon Polyurethane Kogyo Co., Ltd.) | 10 parts |
| **Second Image-receiving Layer** | |
| Vinyl chloride/vinyl acetate copolymer resin | amount described in Table 6 |
| Above-mentioned metal source (MS-1) | amount described in Table 6 |
| Polyester modified silicone (X-24-8300 manufactured by Shin-Etsu Chemical Co., Ltd.) | 0.5 part |
| **First Image-receiving Layer** | |
| Vinyl chloride/vinyl acetate copolymer resin (VYHD manufactured by Union Carbide Co., Ltd. | 90 parts |

-continued

| | |
|---|---|
| Isocyanate (Coronate HX manufactured by Nippon Polyurethane Kogyo Co., Ltd.) | 10 parts |
| **Second Image-receiving Layer** | |
| Vinyl chloride/vinyl acetate copolymer resin | amount described in Table 7 |
| Above-mentioned metal source (MS-1) | amount described in Table 7 |
| Epoxy-modified silicone (KF-393 manufactured by Shin-Etsu Chemical Co., Ltd.) | 1 part |
| Amino-modified silicone (KS-343 manufactured by Shin-Etsu Chemical Co., Ltd.) | 1 part |

Table 7 below shows the results.

TABLE 7

| Sample No. | Metal Source-containing Layer MS-1 in part | KY-24 in part | GP-200 in part | Image-receiving Layer MS-1 in part | BX-1 in part | Density Remaining Ratio Y % | M % | C % | Chelation Ratio Y % | M % | C % | Hue of Image-receiving Layer |
|---|---|---|---|---|---|---|---|---|---|---|---|---|
| 6-1 | 1 | 62.7 | 31.3 | 49.5 | 50.5 | 99 | 96 | 96 | 99 | 99 | 99 | B |
| 6-2 | 5 | 60.0 | 30.0 | 49.5 | 50.5 | 99 | 96 | 96 | 99 | 99 | 99 | B |
| 6-3 | 1 | 62.7 | 31.3 | 39.5 | 60.5 | 99 | 95 | 96 | 99 | 99 | 99 | B |
| 6-4 | 5 | 60.0 | 30.0 | 39.5 | 60.5 | 99 | 95 | 96 | 99 | 99 | 99 | B |
| 6-5 | 10 | 56.7 | 28.3 | 39.5 | 60.5 | 99 | 95 | 96 | 99 | 99 | 99 | B |
| 6-6 | 1 | 62.7 | 31.3 | 31.5 | 68.5 | 99 | 95 | 96 | 99 | 99 | 99 | A |
| 6-7 | 5 | 60.0 | 30.0 | 31.5 | 68.5 | 99 | 95 | 96 | 99 | 99 | 99 | A |
| 6-8 | 10 | 56.7 | 28.3 | 31.5 | 68.5 | 99 | 95 | 96 | 99 | 99 | 99 | A |
| 6-9 | 1 | 62.7 | 31.3 | 22 | 78 | 99 | 94 | 95 | 99 | 99 | 99 | A |
| 6-10 | 5 | 60.0 | 30.0 | 22 | 78 | 99 | 95 | 96 | 99 | 99 | 99 | A |
| 6-11 | 10 | 56.7 | 28.3 | 22 | 78 | 99 | 95 | 96 | 99 | 99 | 99 | A |
| 6-12 | 1 | 62.7 | 31.3 | 11.5 | 88.5 | 98 | 92 | 93 | 98 | 97 | 97 | A |
| 6-13 | 5 | 60.0 | 30.0 | 11.5 | 88.5 | 98 | 93 | 94 | 98 | 98 | 97 | A |
| 6-14 | 10 | 56.7 | 28.3 | 11.5 | 88.5 | 99 | 94 | 95 | 99 | 99 | 98 | A |
| 6-15 | 20 | 50.0 | 25.0 | 11.5 | 88.5 | 99 | 95 | 96 | 99 | 99 | 99 | A |
| 6-16 | 1 | 62.7 | 31.3 | 6.5 | 93.5 | 98 | 91 | 92 | 97 | 97 | 96 | A |
| 6-17 | 5 | 60.0 | 30.0 | 6.5 | 9.3.5 | 98 | 92 | 93 | 98 | 97 | 97 | A |
| 6-18 | 10 | 56.7 | 28.3 | 6.5 | 93.5 | 98 | 93 | 94 | 98 | 98 | 97 | A |
| 6-19 | 20 | 50.0 | 25.0 | 6.5 | 93.5 | 99 | 94 | 95 | 99 | 99 | 98 | A |
| 6-20 | 0 | 63.3 | 31.7 | 49.5 | 50.5 | 99 | 90 | 92 | 95 | 96 | 95 | B |
| 6-21 | 0 | 63.3 | 31.7 | 39.5 | 60.5 | 98 | 88 | 90 | 94 | 95 | 94 | B |
| 6-22 | 0 | 63.3 | 31.7 | 22 | 78 | 88 | 80 | 82 | 90 | 85 | 85 | A |
| 6-23 | 0 | 63.3 | 31.7 | 11.5 | 88.5 | 40 | 34 | 37 | 40 | 38 | 37 | A |
| 6-24 | 0 | 63.3 | 31.7 | 0 | 100 | 12 | 18 | 14 | 0 | 0 | 0 | A |

Example 7

An ink sheet was prepared in the same manner as in Example 2 except that no metal source (MS-1) in the composition of the second image-receiving layer of the image-receiving element in Example 6 was added and the amount of resin in the composition of the image-receiving element was increased by the equivalent resin amount, and the composition of each ink layer was changed to that described in Table 8 below and same experiments were carried out. The results are shown In Table 8.

TABLE 8

| Sample No. | Metal Source-containing Layer MS-1 in part | KY-24 in part | GP-200 in part | Density Remaining Ratio Y % | M % | C % | Chelation Ratio Y % | M % | C % | Hue of Image-receiving Layer |
|---|---|---|---|---|---|---|---|---|---|---|
| 7-1 | 1 | 66.0 | 33.0 | 98 | 93 | 94 | 98 | 97 | 96 | A |
| 7-2 | 5 | 64.0 | 31.0 | 99 | 94 | 95 | 99 | 98 | 97 | A |
| 7-3 | 10 | 60.0 | 30.0 | 99 | 95 | 96 | 99 | 99 | 98 | A |
| 7-4 | 20 | 53.0 | 27.0 | 99 | 96 | 96 | 99 | 99 | 99 | A |

Example 8

The experiment was carried out in the same manner as in Example 7 except that as the ink sheet, the same ink sheet as that of Example 3 was employed. The results are shown in Table 9 below.

TABLE 9

| Sample No. | Metal Source-containing Layer MS-1 in part | KY-24 in part | GP-200 in part | Density Remaining Ratio Y % | M % | C % | Chelation Ratio Y % | M % | C % | Hue of Image-receiving Layer |
|---|---|---|---|---|---|---|---|---|---|---|
| 8-1 | 1 | 66.0 | 33.0 | 98 | 93 | 94 | 98 | 97 | 96 | A |
| 8-2 | 5 | 64.0 | 31.0 | 99 | 94 | 95 | 99 | 98 | 97 | A |
| 8-3 | 10 | 60.0 | 30.0 | 99 | 95 | 96 | 99 | 99 | 98 | A |
| 8-4 | 20 | 53.0 | 27.0 | 99 | 96 | 96 | 99 | 99 | 99 | A |

Example 9

An experiment was carried out in the same manner as in Example 7 except that as the ink sheet, the same ink sheet as that of Example 4 was employed. The results are shown in Table 10 below.

TABLE 10

| Sample No. | Metal Source-containing Layer MS-1 in part | KY-24 in part | GP-200 in part | Density Remaining Ratio Y % | M % | C % | Chelation Ratio Y % | M % | C % | Hue of Image-receiving Layer |
|---|---|---|---|---|---|---|---|---|---|---|
| 9-1 | 1 | 66.0 | 33.0 | 98 | 93 | 94 | 98 | 97 | 96 | A |
| 9-2 | 5 | 64.0 | 31.0 | 99 | 94 | 95 | 99 | 98 | 97 | A |
| 9-3 | 10 | 60.0 | 30.0 | 99 | 95 | 96 | 99 | 99 | 98 | A |
| 9-4 | 20 | 53.0 | 27.0 | 99 | 96 | 96 | 99 | 99 | 99 | A |

According to the invention, the keeping quality of a thermally transferred photographic image is improved without the dimensional increase in an apparatus and the extreme extension of a processing time.

We claim:

1. An image forming method comprising the steps of:

superposing an image-receiving layer of an image-receiving element comprising
a support and
the image-receiving layer, on an ink layer of an ink sheet comprising
a support and
an ink layer containing a dye chelatable with a metal ion-containing compound, imagewise-heating the ink sheet by a heating device so that the dye of the ink layer is transferred to the image-receiving layer to form an image on the image-receiving layer, then superposing the image-receiving layer in which the image has been formed on a sheet containing a metal ion-containing compound, and heating the sheet containing the metal ion-containing compound by a heating device so that the metal ion-containing compound is transferred to the image-receiving layer having the image.

2. The image forming method of claim 1, wherein the ink sheet comprises a dye-containing region which comprises a dye chelatable with said metal ion-containing compound, and a metal ion-containing compound-comprising region which comprises said metal ion-containing compound and substantially no dye, and the sheet containing the metal ion-containing compound is the ink sheet.

3. An image forming method of claim 2, wherein the dye-containing region of the ink sheet is composed of an yellow dye-containing region, a magenta dye-containing region and a cyan dye-containing region and the metal ion-containing compound-comprising region is formed next to the dye-containing regions.

4. An image forming method of claim 2, wherein the dye-containing region is a black dye-containing region and said metal ion-containing compound-comprising region is formed next said region.

5. An image forming method of claim 2, wherein the dye-containing region is composed of an yellow dye-containing region, a magenta dye-containing region, a cyan dye-containing region and a black dye-containing region and said metal ion-containing compound-comprising region is formed next these dye-forming regions.

6. An image forming method of claim 1, wherein the the image-receiving layer further contains the metal ion-containing compound.

7. An image forming method of claim 1, wherein the image-receiving layer contains a releasing agent.

8. An image forming method of claim 1, wherein the heating device is a thermal head.

9. An image forming method of claim 1, wherein the dye is sublimable dye.

10. An image forming method comprising the steps of:

superposing an image-receiving layer of an image-receiving element comprising
a support and
the image-receiving layer on an ink layer region of an ink sheet comprising
a support,
said ink layer region containing a dye chelatable with a metal ion-containing compound, and
a metal ion-containing compound-containing region which contains said metal ion-containing compound and substantially no dye, imagewise-heating the ink sheet by a heating device so that the dye of the ink layer region is transferred to the image-receiving layer to form an image on the image-receiving layer, then superposing the image receiving layer in which the image has been formed on the ink sheet at the metal ion-containing compound-containing region of the ink sheet, and heating the ink sheet by a heating device so that the metal ion-containing compound is transferred to the image-receiving layer having the image.

11. An image forming method of claim 10, wherein the dye-containing region of the ink sheet is composed of an yellow dye-containing region, a magenta dye-containing region and a cyan dye-containing region and the metal ion-containing compound-comprising region is formed next to the dye-containing regions.

* * * * *